US009327255B2

(12) United States Patent
Ito et al.

(10) Patent No.: US 9,327,255 B2
(45) Date of Patent: May 3, 2016

(54) MICROCHEMICAL ANALYSIS DEVICE, A MICRO MIXING DEVICE, AND A MICROCHEMICAL ANALYSIS SYSTEM COMPRISING THE SAME

(75) Inventors: Naoko Ito, Otawara (JP); Shoichi Kanayama, Otawara (JP)

(73) Assignees: Kabushiki Kaisha Toshiba, Tokyo (JP); Toshiba Medical Systems Corporation, Otawara-shi (JP)

( * ) Notice: Subject to any disclaimer, the term of this patent is extended or adjusted under 35 U.S.C. 154(b) by 253 days.

(21) Appl. No.: 11/946,339

(22) Filed: Nov. 28, 2007

(65) Prior Publication Data

US 2008/0124245 A1 May 29, 2008

(30) Foreign Application Priority Data

Nov. 29, 2006 (JP) ..... 2006-321306

(51) Int. Cl.

*B01F 13/00* (2006.01)
*B01F 11/00* (2006.01)
*B01F 11/02* (2006.01)
(Continued)

(52) U.S. Cl.

CPC ..... *B01F 13/0064* (2013.01); *B01F 11/0045* (2013.01); *B01F 11/0258* (2013.01); *B01L 3/5027* (2013.01); *B01F 15/00207* (2013.01); *B01F 15/00214* (2013.01); *B01L 2200/04* (2013.01); *B01L 2200/143* (2013.01); *B01L 2300/0654* (2013.01); *B01L 2300/0816* (2013.01); *B01L 2300/0867* (2013.01)

(58) Field of Classification Search

CPC ..... B01F 15/00207; B01F 15/00214; B01F 15/00285; B01F 15/00363; B01F 15/00383; B01F 15/00389; B01F 11/2058; B01F 13/0064; B01L 3/05027
USPC ..... 422/68.1, 82.05, 128
See application file for complete search history.

(56) References Cited

U.S. PATENT DOCUMENTS 5,859,708 A * 1/1999 Feldman ..... 356/406
6,210,128 B1 * 4/2001 Rife et al. ..... 417/322
(Continued)

FOREIGN PATENT DOCUMENTS

CN 1542429 A 11/2004
JP 60-192264 9/1985
(Continued)

OTHER PUBLICATIONS

U.S. Appl. No. 12/164,371, filed Jun. 30, 2008, Omuro, et al.
(Continued)

*Primary Examiner* — Jonathan Hurst
(74) *Attorney, Agent, or Firm* — Oblon, McClelland, Maier & Neustadt, L.L.P

(57) ABSTRACT

By situating a mixing pot in a junction of a first solution and a second solution or after the junction in a channel to temporarily retain these solutions, and situating an analysis sensor downstream from the mixing pot to detect the result of reaction of the first solution and second solution, heterogeneous solutions are mixed so as to react within the channel, and chemical analysis of one of the solutions is performed. According to this system, before the solutions have fully flowed through the remainder of the channel following the junction, the solutions are mixed uniformly at once by the turbulent and vortex flow generated within the mixing pot.

15 Claims, 21 Drawing Sheets

(51) Int. Cl.
*B01L 3/00* (2006.01)
*B01F 15/00* (2006.01)

(56) References Cited

U.S. PATENT DOCUMENTS

| | | | | |
|---|---|---|---|---|
| 6,238,910 | B1 | 5/2001 | Custance et al. | |
| 6,468,761 | B2 * | 10/2002 | Yang et al. | 435/23 |
| 6,692,708 | B2 * | 2/2004 | Chandler, Jr. | 422/225 |
| 6,939,032 | B2 * | 9/2005 | Cosby et al. | 366/114 |
| 2004/0115097 | A1 | 6/2004 | Wixforth et al. | |
| 2005/0150830 | A1 * | 7/2005 | Laugharn et al. | 210/634 |

FOREIGN PATENT DOCUMENTS

| | | | |
|---|---|---|---|
| JP | 2001-252897 | | 9/2001 |
| JP | 2002-071698 | | 3/2002 |
| JP | 2004-53370 | | 2/2004 |
| JP | 2004-184315 | A | 7/2004 |
| JP | 2005-164549 | A | 6/2005 |
| JP | 2006-153785 | | 6/2006 |
| JP | 2006-239499 | A | 9/2006 |
| JP | 2006-266974 | | 10/2006 |
| WO | WO 01/07892 | A1 | 2/2001 |
| WO | WO 2004/081741 | A2 | 9/2004 |
| WO | 2005/018787 | | 3/2005 |

OTHER PUBLICATIONS

Ryu et al., Micro Magnetic Stir-Bar Mixer Integrated With Parylene Microfluidic Channels, Oct. 14, 2004.
Liu, et al., Conductivity Detection for Monitoring Mixing Reaction in Microfluidic Devices, Apr. 30, 2001, pp. 1248-1251.
Japanese Office Action (2006-321306) dated Nov. 8, 2011, w/English Translation.
Japanese Office Action Issued Apr. 9, 2013 in Patent Application No. 2012-001860.
Combined Office Action and Search Report issued Oct. 14, 2013 in Chinese Patent Application No. 201310153917.0.
Japanese Office Action (2012-001860) dated Jul. 2, 2013.

* cited by examiner

MICROCHEMICAL ANALYSIS DEVICE, A MICRO MIXING DEVICE, AND A MICROCHEMICAL ANALYSIS SYSTEM COMPRISING THE SAME

BACKGROUND OF THE INVENTION

1. Field of the Invention

The present invention relates to a technique for mixing heterogeneous solutions by using a small-size device in order to analyze the chemical property of one of the solutions from the result of reaction of the heterogeneous solutions.

2. Description of the Related Art

A chemical analysis system makes a sample solution react chemically or biochemically with a reagent solution, and analyzes the result of the reaction. Thus, the system measures the chemical property of the sample solution. This chemical analysis system is used for a blood test, infection diagnosis, genetic diagnosis, genetic analysis, or observation of gene synthesis, mechanofusion, coupling reaction, organometallic reaction, catalytic synthesis reaction, electrolytic synthesis reaction, acid alkali decomposition reaction and electrolysis reaction. For example, the chemical analysis system makes a sample solution such as serum and urine of a subject react chemically or biochemically with a reagent solution, performs photometry, and analyzes various items such as cholesterol level, triglyceride level, blood glucose level, and GOT activity level.

For this purpose, this chemical analysis system dispenses a sample and mixes with a reagent solution, and makes the sample solution and the reagent solution react. Then, the chemical analysis system detects the result of the reaction, and converts data on the reaction into a physical quantity indicative of the chemical property of the sample solution. Finally, the chemical analysis system outputs the obtained physical quantity in a visible form. A typical example is a chemical analysis system disclosed in Japanese patent publication No. 3300704, which measures the concentration or activity of a substance or enzyme within a test sample. This chemical analysis system automatically dispenses the test sample and a reagent appropriate for a measurement item into a reaction tube by certain quantities, stirs and mixes, and then makes them react at a certain temperature. Then, on the basis of measurement of a change in color tone caused by the reaction, the chemical analysis system measures the concentration or activity of the substance or enzyme within the test sample.

In recent years, the chemical analysis system has become smaller in size. For example, there have been proposed a portable blood analyzer that utilizes a cassette-type channel disclosed in Japanese patent publication No. 2995088, and a mobile chemical examination device using a sheet-like microreactor disclosed in Japanese unexamined patent publication No. 2002-340911.

In general, the microchemical analysis system delivers a sample solution and a reagent solution in the merged stage through a common channel, thereby mixing the sample solution and the reagent solution while delivering through the channel by utilizing the molecular diffusion effect. However, in order to completely mix within the channel, this channel needs to be sufficiently long. Therefore, such a mechanism is an impediment on size reduction. Moreover, when the solutions are mixed gradually while being delivered within the channel, there is the fear that the result of reaction is measured while the reaction is incomplete, which is more likely to cause an error in result of the reaction.

Consequently, various types of mixing acceleration means may be installed within a channel in order to accelerate mixture within the channel. Examples of the mixing acceleration means include a technique disclosed in Japanese unexamined patent publication No. 2006-153785, which transforms part of a channel in which a sample solution and a reagent solution are merged and delivered to apply a transforming force as a stirring force. Another example is a technique disclosed in U.S. unexamined patent publication No. 2004/0115097, which utilizes surface acoustic waves that are excited on the surface of a piezoelectric body by distortion of the surface of the piezoelectric body. In such microchemical analysis systems, the mixing acceleration means is provided within a channel that delivers a sample solution and a reagent solution in the merged state.

A technique of providing mixing acceleration means in the channel to accelerate mixture has been developed in existing microchemical analysis systems. However, the mixing acceleration means provided in the channel may cause a problem of insufficient stirring effect. This is because a sample solution and a reagent solution are delivered spreading inside a channel and, when mixing acceleration means is situated in a section of the channel, a stirring force is applied only to part of the sample solution and reagent solution passing through the section provided with the mixing acceleration means. In other words, it is impossible totally stir the sample solution and the reagent solution. Moreover, it takes a long time to stir fully.

Even if the mixing acceleration means is provided, it is the same as gradually mixing that mixture of the solutions is accelerated for every part of the solutions passing through the mixing acceleration means. Therefore, the reaction may become nonuniform, and the reaction system may differ, with the result that an error arises in result of the reaction.

SUMMARY OF THE INVENTION

An object of the present invention is to, regarding a technique of mixing heterogeneous solutions by using a small-size device in order to analyze the chemical property of one of the solutions from the result of reaction of the heterogeneous solutions, provide a technique for mixing the heterogeneous solutions uniformly in a short time.

In a first aspect of the present invention, a microchemical analysis system is a system comprising: an analysis sensor configured to detect a result of reaction of a first solution and a second solution; and a processing part configured to convert a result of the reaction outputted by the analysis sensor into a physical quantity indicative of a chemical property of the solution. This microchemical analysis system comprises a channel and a mixing pot. The channel merges and delivers the first solution and the second solution. The mixing pot bulges out from the channel to have a predetermined capacity, and is interposed in a junction of the first solution and the second solution or in the channel after the junction to temporarily retain the first solution and second solution. Furthermore, this microchemical analysis system comprises a mixing acceleration part, a monitoring part, and a mixing controller. The mixing acceleration part applies a stirring force to the inside of the mixing pot. The monitoring part monitors a degree of mixture of the first solution and the second solution within the mixing pot. The mixing controller controls the mixing acceleration part based on a result of monitoring by the monitoring part.

In a second aspect of the present invention, a micro mixing device mixes heterogeneous solutions. This micro mixing device comprises a channel and a mixing pot. The channel merges and delivers the first solution and the second solution. The mixing pot bulges out from the channel to have a predetermined capacity, and is interposed in a junction of the first solution and the second solution or in the channel after the junction to temporarily retain the first solution and the second solution. Furthermore, this microchemical analysis system comprises a mixing acceleration part, a monitoring part, and a mixing controller. The mixing acceleration part applies a stirring force to the inside of the mixing pot. The monitoring part monitors a degree of mixture of the first solution and the second solution within the mixing pot. The mixing control part controls the mixing acceleration part based on a result of monitoring by the monitoring part.

In a third aspect of the present invention, a microchemical analysis device is connected to a micro mixing device and, from a result of reaction of heterogeneous solutions mixed by the micro mixing device, analyzes a chemical property of one of the solutions. The micro mixing device comprises: a channel that merges and delivers the first solution and the second solution; and a mixing pot that is interposed in a junction of the first solution and the second solution or in the channel after the junction, that bulges out from the channel to have a predetermined capacity, and that temporarily retains the first solution and the second solution. The microchemical analysis device connected to the micro mixing device comprises a mixing acceleration part, a monitoring part, and a mixing controller. The mixing acceleration part applies a stirring force to the inside of the mixing pot. The monitoring part monitors a degree of mixture of the first solution and the second solution within the mixing pot. The mixing controller controls the mixing acceleration part based on a result of monitoring by the monitoring part.

According to the first to third aspects, since a stirring force is applied to the inside of the mixing pot in which most of the first solution and second solution is retained, a turbulent flow or a vortex flow is generated within the mixing pot, and the first solution and the second solution are mixed at once. Then, the mixing accelerating part is controlled based on the result of monitoring by the monitoring part, so that it is possible to apply a sufficient stirring force until the first solution and the second solution are uniformly mixed. Consequently, uniform mixture can be completed within the mixing pot, and a section of the channel after the junction becomes short, so that size reduction of the system and device is allowed. Further, since the monitoring part and the mixing acceleration part are disposed within the mixing pot that temporarily retains most of the first solution and second solution, the need to provide the mixing acceleration part and the monitoring part in multiple stages along the channel is eliminated, and the size of the system and device can be reduced.

DETAILED DESCRIPTION OF THE EMBODIMENT

Hereinafter, each embodiment of the microchemical analysis system according to the present invention will be described in detail with reference to the drawings.

Figure 1:
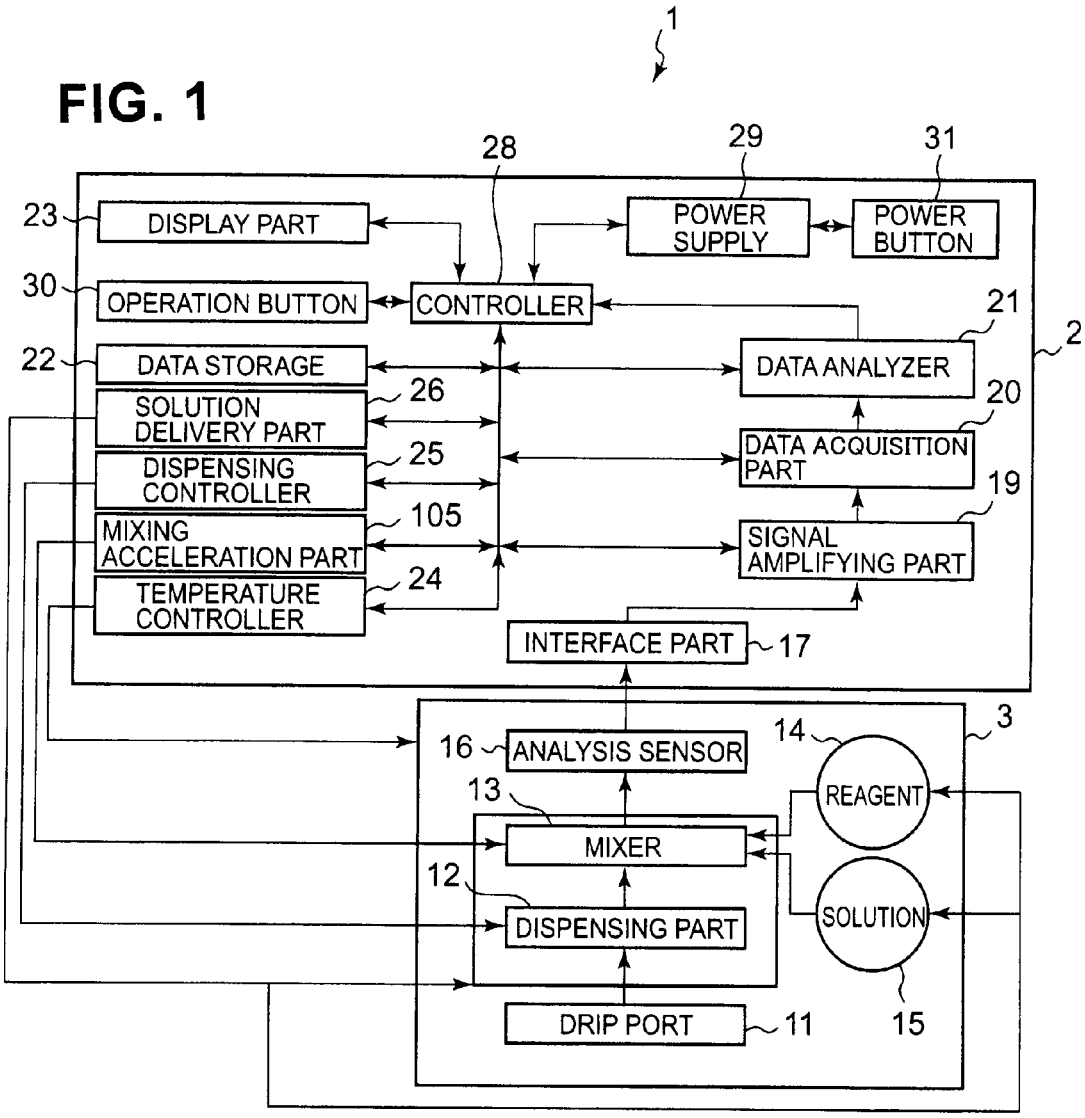
FIG. 1 is a diagram illustrating a structural diagram of the chemical analysis system according to the present embodiment.

FIG. 1 is a diagram illustrating a structural diagram of the microchemical analysis system according to the present embodiment. A microchemical analysis system 1 (hereinafter simply referred to as the "chemical analysis system 1") is a system configured to make a sample solution react chemically or biochemically with a reagent solution to analyze the result of the reaction. Consequently, the chemical property of the sample solution is measured. The chemical analysis system 1 is used for a blood test, infection diagnosis, genetic diagnosis, genetic analysis, or observation of gene synthesis, mechanofusion, coupling reaction, organometallic reaction, catalytic synthesis reaction, electrolytic synthesis reaction, acid alkali decomposition reaction and electrolysis reaction. For example, the chemical analysis system 1 makes a sample solution such as serum of a subject react chemically or biochemically with a reagent solution, performs measurement, and analyzes various items such as the cholesterol level, triglyceride level, blood glucose level, and GOT activity level.

This chemical analysis system 1 dispenses the sample solution and mixes with the reagent solution, and makes the sample solution and the reagent solution react. Then, the chemical analysis system 1 detects the result of the reaction and converts data on the reaction into a physical quantity indicative of the chemical property of the sample solution. Finally, the chemical analysis system 1 outputs the obtained physical quantity in a visible form to a monitor, a printing paper, or the like.

This chemical analysis system 1 has a configuration in which an analysis device 2 and a mixing device 3 are connected via an interface part 17. The analysis device 2 is a device configured to analyze the result of reaction. The mixing device 3 is a device configured to mix a sample solution with a reagent solution, make them react, and detect the result of the reaction. This mixing device 3 is a handy cartridge or chip. In the chemical analysis system 1, the result of the reaction detected by the mixing device 3 is outputted to the analysis device 2, and is chemically analyzed by the analysis device 2. The interface part 17 sends data outputted by the mixing device 3 into the analysis device 2. The data outputted by the mixing device 3 is reaction data obtained by detecting the reaction of the sample solution and the reagent solution, and monitoring-result data obtained by detecting the degree of mixture of the sample solution and the reagent solution.

The mixing device 3 comprises a drip port 11, a dispensing part 12, a mixer 13, a reagent-containing part 14, a solution-containing part 15, and an analysis sensor 16.

The sample solution is dripped into the drip port 11 by an analyst. By dripping the sample solution into the drip port 11, the sample solution is introduced into the mixing device 3. The drip port 11 is connected to the mixer 13 via the dispensing part 12. The dispensing part 12 includes a valve, and dispenses a predetermined quantity of the sample solution dripped into the drip port 11 and sends to the mixer 13.

The reagent-containing part 14 and the solution-containing part 15 are connected to the mixer 13 via flappers such as valves. The reagent-containing part 14 retains a reagent solution that reacts with the sample solution when mixed therewith. Further, the solution-containing part 15 retains a dilute solution that regulates the condition of the sample solution, a calibration solution that becomes the standard of measurement, or the like. From the reagent-containing part 14 or the solution-containing part 15, a predetermined quantity of the prepared reagent solution is sent out to the mixer 13.

In the mixer 13, the sample solution and the reagent solution are mixed to react, and a reaction occurs. The degree of mixture of the sample solution and the reagent solution is detected in the mixer 13, and outputted to the analysis device 2 as monitoring-result data.

An analysis sensor 16 is situated as a latter part of the mixer 13 in the channel. As for this analysis sensor 16, it is possible to employ an optical measurement method of measuring a change in color and a change in turbidity accompanying the reaction of the sample solution and the reagent solution, or an electrochemical measurement method of measuring a change of electric current or voltage accompanying the reaction of the sample solution and the reagent solution. The analysis sensor 16 outputs data on the reaction obtained by the optical measurement method or the electrochemical measurement method. The reaction data outputted by the analysis sensor 16 is sent to the analysis device 2 via the interface part 17. A part forming the analysis sensor 16 may be situated in the analysis device 2.

The analysis device 2 comprises a power supply 29 and a power button 31. When the power button 31 is pressed down, electric power is supplied from the power supply 29 to each component of the analysis device 2. The analysis device 2 is driven by this electric power. The analysis device 2 processes the reaction data and outputs the result of the reaction. This analysis device 2 comprises a signal amplification part 19, a data acquisition part 20 and a data analyzer 21, as a configuration to process reaction data. Electrical connection is established between the interface part 17 and signal amplification part 19, between the signal amplification part 19 and data acquisition part 20, and between the data acquisition part 20 and data analyzer 21. Moreover, the analysis device 2 comprises a data storage 22 and a display part 23, as a configuration to output the result of the reaction.

The signal amplification part 19 amplifies the monitoring-result data and reaction data obtained via the interface part 17. The signal amplification part 19 outputs the monitoring-result data and reaction data having been amplified to the data acquisition part 20. The data acquisition part 20 includes an A/D converter circuit and a memory circuit. This data acquisition part 20 digitally converts the amplified monitoring-result data and reaction data, and temporarily stores. The data analyzer 21 analyzes the monitoring-result data and reaction data acquired by the data acquisition part 20. Upon obtaining the monitoring-result data, the data analyzer 21 executes a process of detecting the degree of mixture of the sample solution and the reagent solution in the mixer 13 from the monitoring-result data. Further, upon obtaining the reaction data, the data analyzer 21 converts the reaction data into data of a physical quantity indicative of the chemical property of the sample solution. For example, when serum of a subject is used as the sample solution, the data analyzer 21 converts the reaction data to physical quantity data indicative of the property of the sample solution such as the cholesterol level, triglyceride level, blood glucose level, and GOT activity level.

The data storage 22 includes RAM (Random Access Memory), and stores the physical quantity data indicative of the property of the sample solution obtained by conversion by the data analyzer 21. The display part 23 includes a display screen such as a liquid crystal display, and displays, in the visible form, the physical quantity data indicative of the property of the sample solution stored by the data storage 22.

This analysis device 2 not only processes the reaction data and outputs the result of the reaction, but also executes control of the mixing device 3. A configuration for this control comprises a temperature controller 24, a dispensing controller 25, a solution delivery part 26, and a mixing acceleration part 105.

The temperature controller 24 includes a heater situated so as to surround the mixing device 3 or a heater situated inside the mixing device 3. This temperature controller 24 controls the temperature so as to maintain a constant temperature within the mixing device 3. The dispensing controller 25 controls the valve of the dispensing part 12 so as to send the predetermined quantity of the sample solution dripped into the drip port 11 to the mixer 13. The solution delivery part 26 applies pressure to the dispensed sample solution and the reagent solution contained in the reagent-containing part 14 and the solution-containing part 15 so that the sample solution and the reagent solution reach the analysis sensor 16 through the mixer 13. The mixing acceleration part 105 stirs the sample solution and the reagent solution within the mixer 13. Through this stirring by the mixing acceleration part 105, uniform mixture of the sample solution and the reagent solution is accelerated.

The analysis device 2 comprises a controller 28. The controller 28 controls drive of each component within the analysis device 2. The controller 28 receives an operation by the analyst using operation buttons 30 disposed to the analysis device 2, and controls drive of each component in accordance with a signal indicating a press of the operation buttons 30. Further, the controller controls the mixing acceleration part 105 in accordance with the result of detection of the degree of mixture of the sample solution and the reagent solution by the data analyzer 21.

Figure 2:
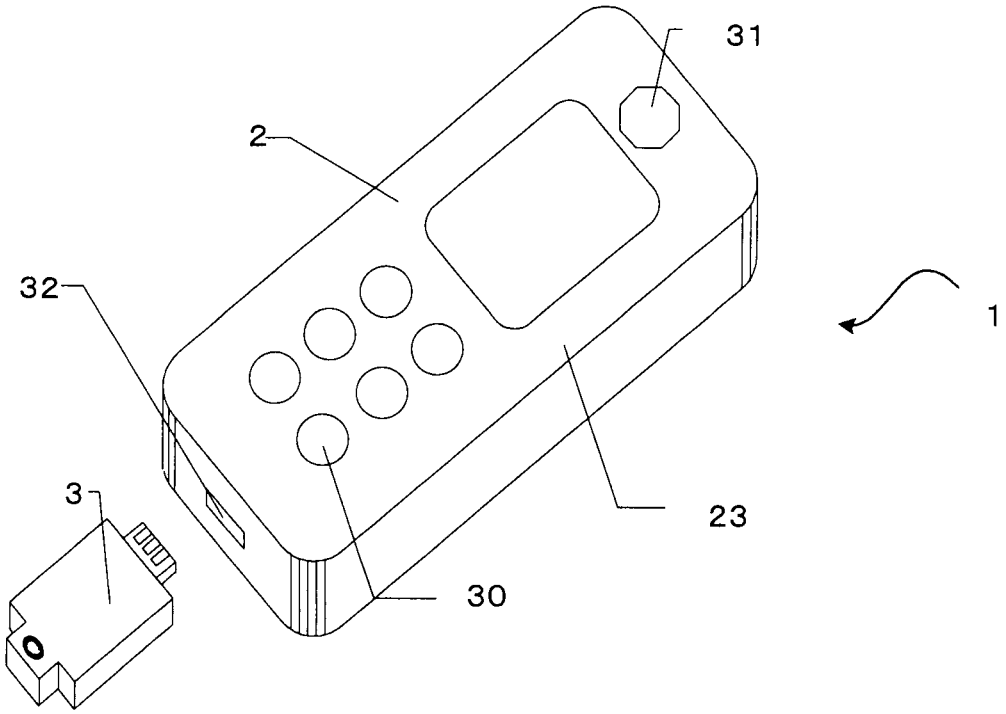
FIG. 2 is a diagram illustrating a first appearance of the chemical analysis system.
Figure 3:
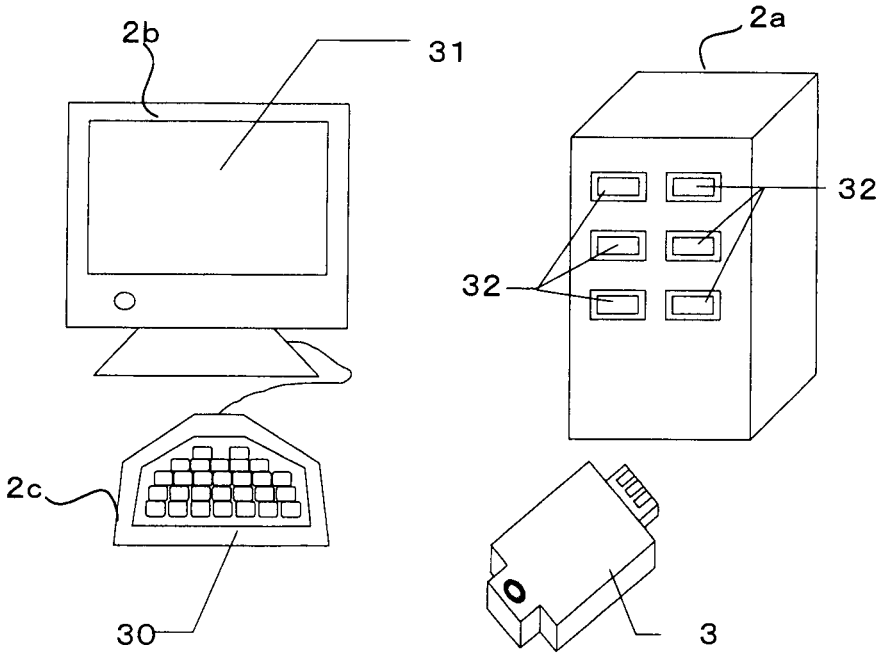
FIG. 3 is a diagram illustrating a second appearance of the chemical analysis system.

FIGS. 2 and 3 are diagrams illustrating the appearance of the chemical analysis system 1. FIG. 2 illustrates a first appearance of the chemical analysis system 1, and FIG. 3 illustrates a second appearance of the chemical analysis system 1.

As illustrated in FIG. 2, the chemical analysis system 1 having the above configuration is composed of the handy analysis device 2 and mixing device 3, for example. This analysis device 2 has a rectangular parallelepiped shape. The power button 31, the display part 23 and the operation buttons 30 are exposed and situated on one surface of the analysis device 2. Further, a cassette insertion slot 32 is made on one side of the analysis device 2. In this cassette insertion slot 32, the interface part 17 is placed. When the mixing device 3 is inserted into the cassette insertion slot 32, the analysis device 2 and the mixing device 3 are electrically connected via the interface part 17, and the reaction data and monitoring-result data are outputted to the analysis device 2.

Moreover, as for the chemical analysis system 1 having the above configuration, as illustrated in FIG. 3, the analysis device 2 is configured by electrically connecting a device chassis 2*a*, a monitor 2*b* and a keyboard 2*c*. The monitor 2*b* forms the display part 23, and the operation buttons 30 are situated on the keyboard 2*c*. The device chassis 2*a* internally contains all components other than the display part 23 and the operation buttons 30. A plurality of cassette insertion slots 32 are made on one surface of the device chassis 2*a*. In the cassette insertion slot 32, the interface part 17 is placed. By inserting the mixing device 3 into the cassette insertion slot 32, the analysis device 2 and the mixing device 3 are electrically connected via the interface part 17, and the reaction data and the monitoring-result data are outputted to the analysis device 2. The analyst operates via the keyboard 2*c*. The result of analysis is displayed on the monitor 2*b*.

Figure 4:
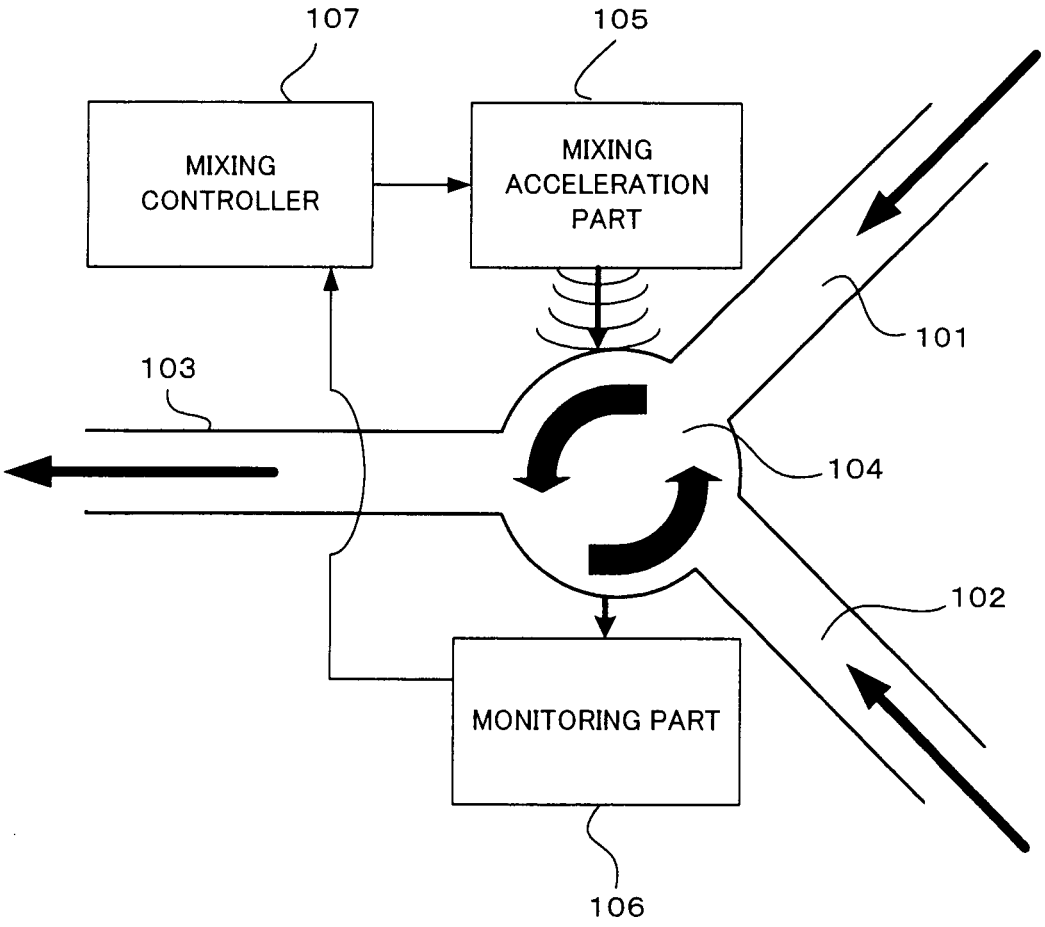
FIG. 4 is a schematic diagram illustrating a first configuration related to mixture of a sample solution with a reagent solution.
Figure 5:
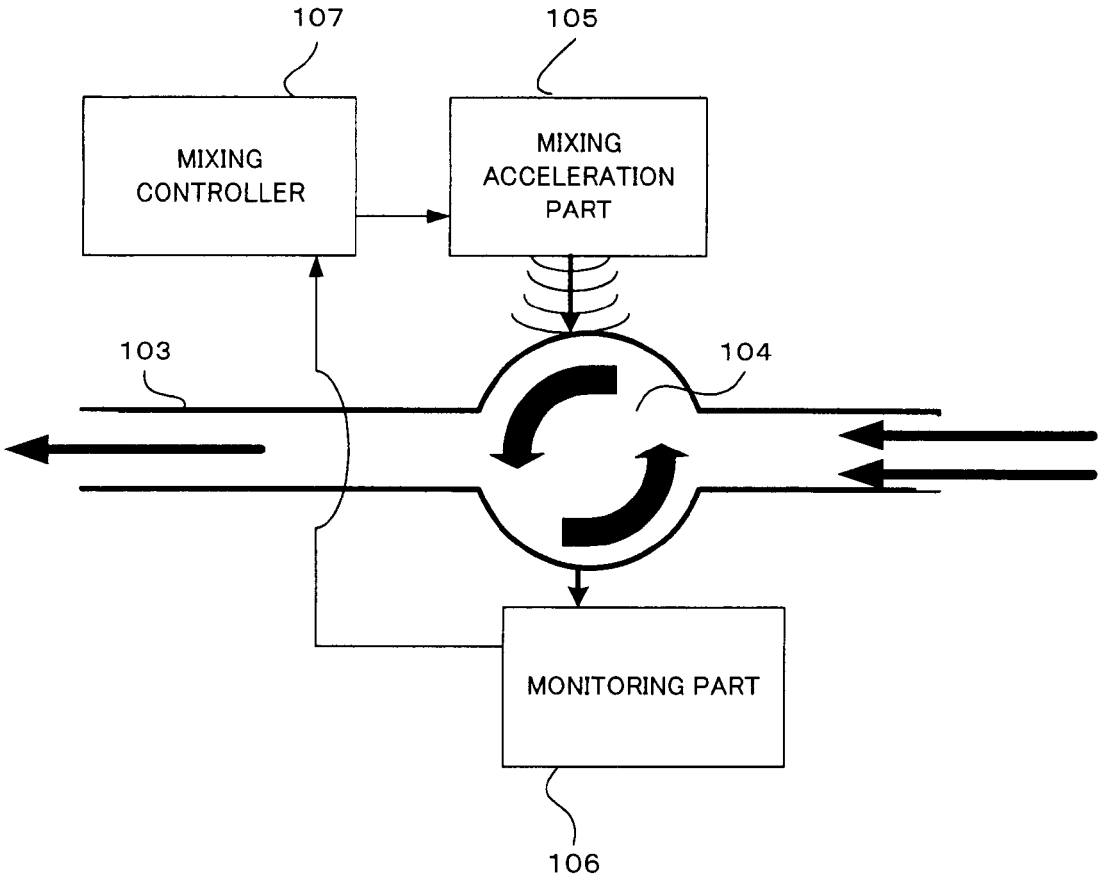
FIG. 5 is a schematic diagram illustrating a second configuration related to mixture of a sample solution with a reagent solution.

FIGS. 4 and 5 are schematic diagrams illustrating a more detailed configuration related to mixture of the sample solution and the reagent solution. FIG. 4 illustrates a first configuration, and FIG. 5 illustrates a second configuration.

As illustrated in FIG. 4, the mixer 13 comprises a first channel 101, a second channel 102, a third channel 103 and a mixing pot 104. One end of the first channel 101 is connected to the solution-containing part 13 and the reagent-containing part 14. The first channel 101 is a channel through which the reagent solution is delivered. One end of the second channel 102 is connected to the dispensing part 12. The second channel 102 is a channel through which the sample solution is delivered. The first channel 101 and second channel 102 are merged, whereby the third channel 103 extends. The analysis sensor 16 is placed downstream of the third channel 103.

The mixing pot 104 is interposed within the third channel 103 that follows the junction of the first channel 101 and second channel 102. In the first configuration, the mixing pot 104 is situated in the junction of the first channel 101 and the second channel 102. The mixing pot 104 has a capacity capable of simultaneously retaining the total sample solution quantity and total reagent solution quantity temporarily. The mixing pot 104 is connected to the first channel 101 and the second channel 102. The reagent solution and the sample solution flow into the mixing pot 104. The mixing pot 104 is further connected to the third channel 103. A mixture solution of the reagent solution and sample solution having been mixed uniformly inside the mixing pot 104 is sent toward the third channel.

The mixing acceleration part 105 is placed in contact with part of the outer shell of the mixing pot 104. The mixing acceleration part 105 applies a stirring force to the inside of the mixing pot 104, and accelerates mixture of the sample solution and the reagent solution. In the vicinity of the mixing pot 104, a monitoring part 106 configured to monitor the inside of the mixing pot 104 is situated. The monitoring part 106 detects the degree of mixture of the sample solution and the reagent solution inside the mixing pot 104. The monitoring part 106 is electrically connected to a mixing controller 107 situated in the analysis device 2. The result of monitoring by the monitoring part 106 is outputted to the mixing controller 107. The mixing controller 107 controls the mixing acceleration part 105 according to the monitoring result.

Further, as illustrated in FIG. 5, in the second aspect, the mixing pot 104 is interposed in mid-flow of the third channel 103. Similarly to the first aspect, the sample solution and the reagent solution flow into the mixing pot 104, and are mixed therein. The mixing acceleration part 105 is placed in contact with part of the outer shell of the mixing pot 104 and applies a stirring force to accelerate mixture. The degree of mixture is monitored by the monitoring part 106 situated in the vicinity of the mixing pot 104. The mixing controller 107 controls the mixing acceleration part 105 in accordance with the result of monitoring by the monitoring part 106.

In the channel configuration according to the first and second aspects of mixture of the sample solution and the reagent solution, most of the sample solution and reagent solution is temporarily retained inside the mixing pot 104. Then, within the mixing pot 104, most of the sample solution and reagent solution is mixed at a time by a turbulent flow or a vortex flow. Therefore, the uniformly mixed sample solution and reagent solution is flown out of the mixing pot 104, and delivered downstream of the third channel 103. Because the need for mixing inside the third channel 103 is reduced at least, the third channel 103 can be shortened, and the size of the mixing device 3 can be reduced.

Moreover, since the reaction starts under a condition that most of the sample solution and reagent solution is retained in one location, it is possible to reduce an error in detection result caused by a condition that the unreacted sample solution and the reacted sample solution are mixed and sent to the analysis sensor 16.

By placing the mixing acceleration part 105 so as to apply a stirring force to the inside of the mixing pot 104 that temporarily retains most of the sample solution and reagent solution, the stirring effect is increased dramatically and the mixing time is reduced, as compared with installing the mixing acceleration part inside the channel and applying a stirring force partially to the mixed solution passing through the installation area of the mixing acceleration part.

Furthermore, by providing the mixing pot 104, the need to provide the mixing acceleration part 105 and the monitoring part 106 alternately in multiple stages along the third channel 103 is eliminated. Therefore, it is possible to reduce cost, and it is also possible to reduce the size of the mixing device 3.

FIGS. 6 through 14 illustrate various aspects of the mixing component that is composed of the mixing pot 104, the mixing acceleration part 105 and the monitoring part 106.

Figure 6:
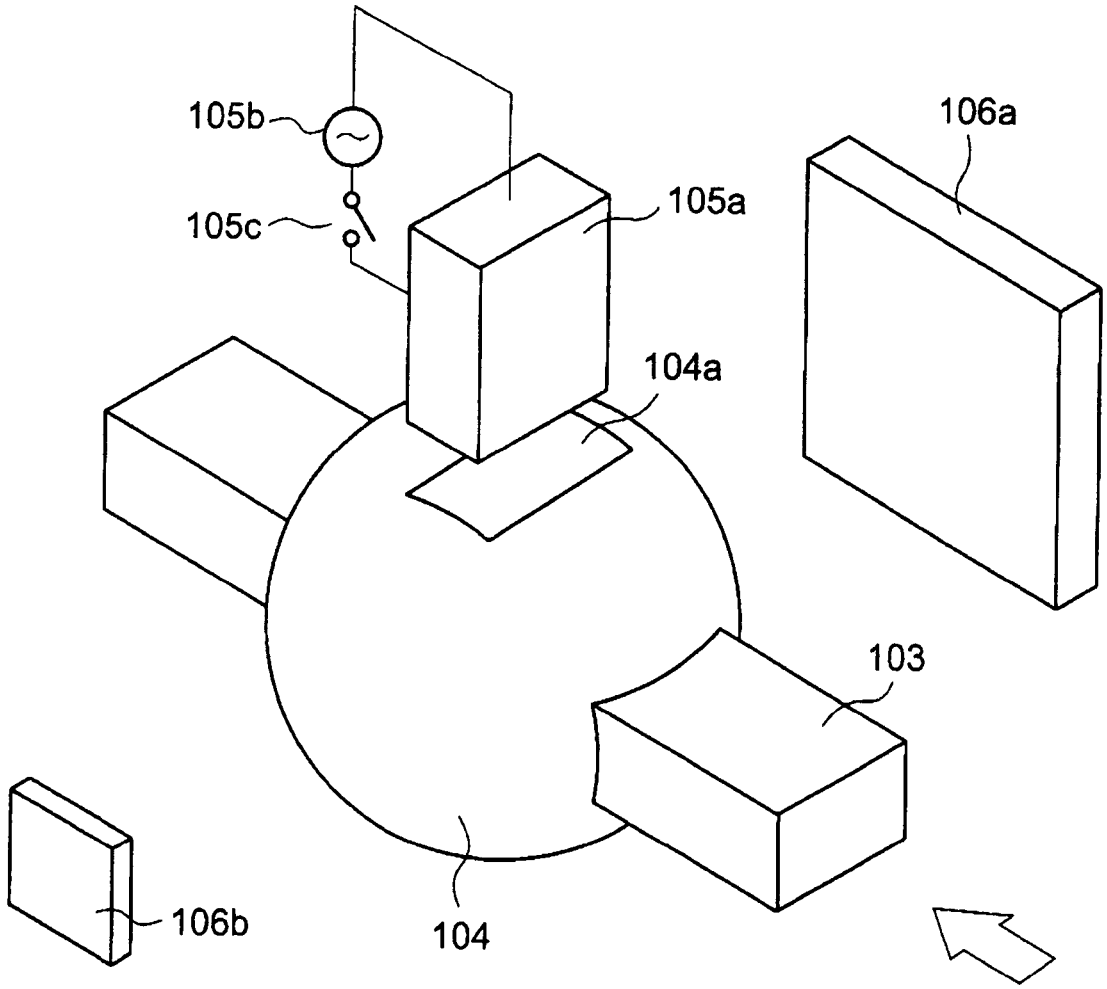
FIG. 6 is a schematic diagram illustrating a first aspect of a mixing component.

FIG. 6 is a schematic diagram illustrating a first aspect of the mixing component. As illustrated in FIG. 6, the mixing pot 104 has a hollow spherical shape and bulges out from the third channel 103. Part of the outer shell that divides the outside from the inside of the mixing pot 104 is formed by a transmission channel 104*a*. This transmission channel 104*a* is composed of resin, and transmits a stirring force generated outside the mixing pot 104, to the inside thereof.

A piezoelectric transducer 105*a* is placed in contact with the transmission channel 104*a* from the outside of the mixing pot 104. A conductive wire is mounted on the piezoelectric transducer 105*a*. The conductive wire is connected to an oscillator 105*b* and a switch 105*c*. The piezoelectric transducer 105*a*, the oscillator 105*b* and the switch 105*c* compose the mixing acceleration part 105. When the switch 105*c* is switched on, the oscillator 105*b* outputs a pulse, and a signal voltage is applied to the piezoelectric transducer 105*a*. The piezoelectric transducer 105*a* is an acoustic/electric reversible conversion element composed of a piezoceramic such as lead titanate. When the signal voltage is applied, the piezoelectric transducer 105*a* is excited by the piezoelectric effect, and transmits vibrational waves. The vibrational waves are transmitted to the inside of the mixing pot 104 through the transmission channel 104*a* placed in contact with the piezoelectric transducer 105*a*, thereby exciting the sample solution and reagent solution inside the mixing pot 104 to accelerate mixture. In other words, the vibrational waves become a stirring force.

The monitoring part 106 includes a light source 106*b* and an image sensor 106*a*. The light source 106*b* and image sensor 106*a* are situated so as to face each other across the mixing pot 104. The light source 106*b* irradiates the mixing pot 104. The image sensor 106*a* obtains a projection image of the mixing pot 104. The image sensor 106*a* is composed of a CCD sensor or a CMOS sensor. The projection image of the mixing pot 104 obtained by the image sensor 106*a* is outputted to the analysis device 2 via the interface part 17. This projection image becomes monitoring-result data indicative of the degree of mixture. When the inhomogeneity of color tone of the projection image is large, it is considered unmixed. When the inhomogeneity of color tone of the projection image is small, it is considered uniformly mixed. The inhomogeneity of color tone refers to a state in which different colors exist in spots, and a state in which there are gradations of darkness. On the basis of analysis of this projection image, the switch 105*c* is switched on/off and the amplitude and cycle of the pulse outputted by the oscillator 105*b* are controlled to regulate the stirring force.

Figure 7:
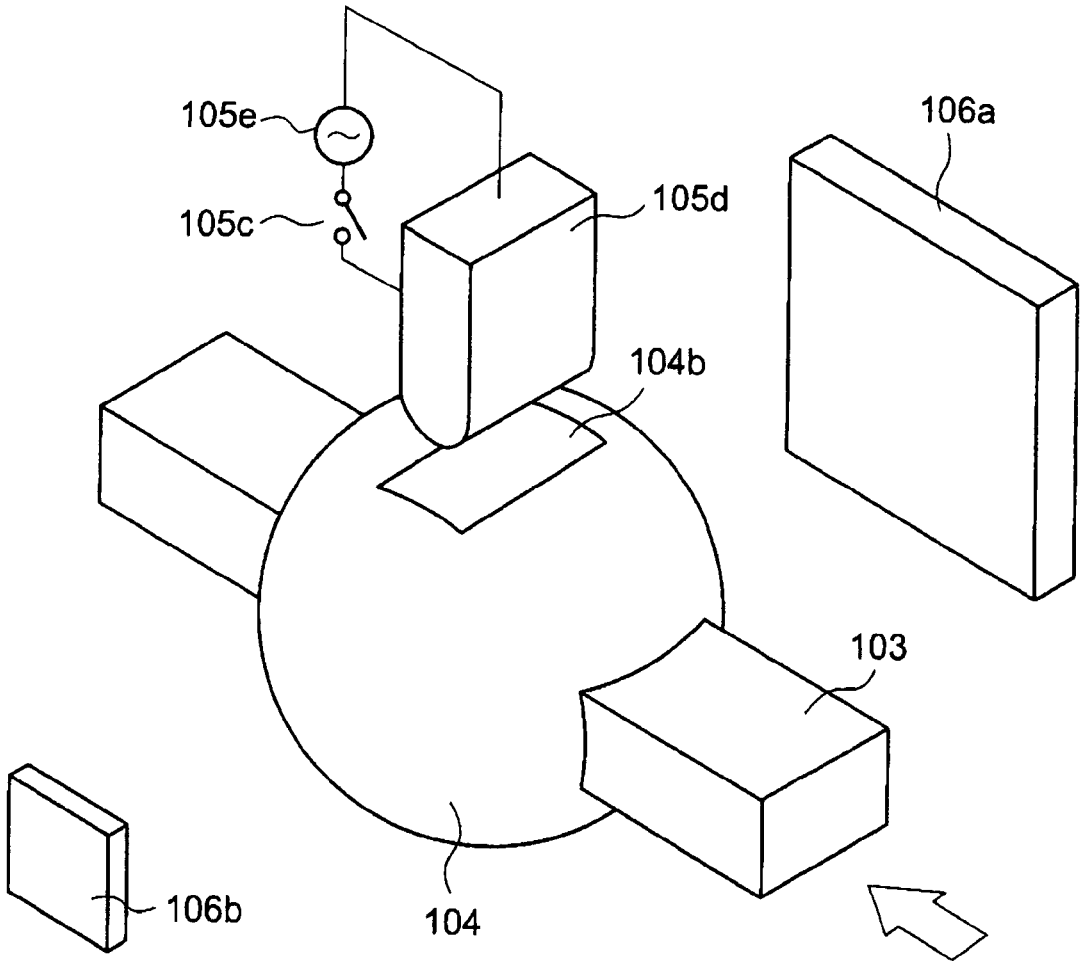
FIG. 7 is a schematic diagram illustrating a second aspect of the mixing component.
Figure 8:
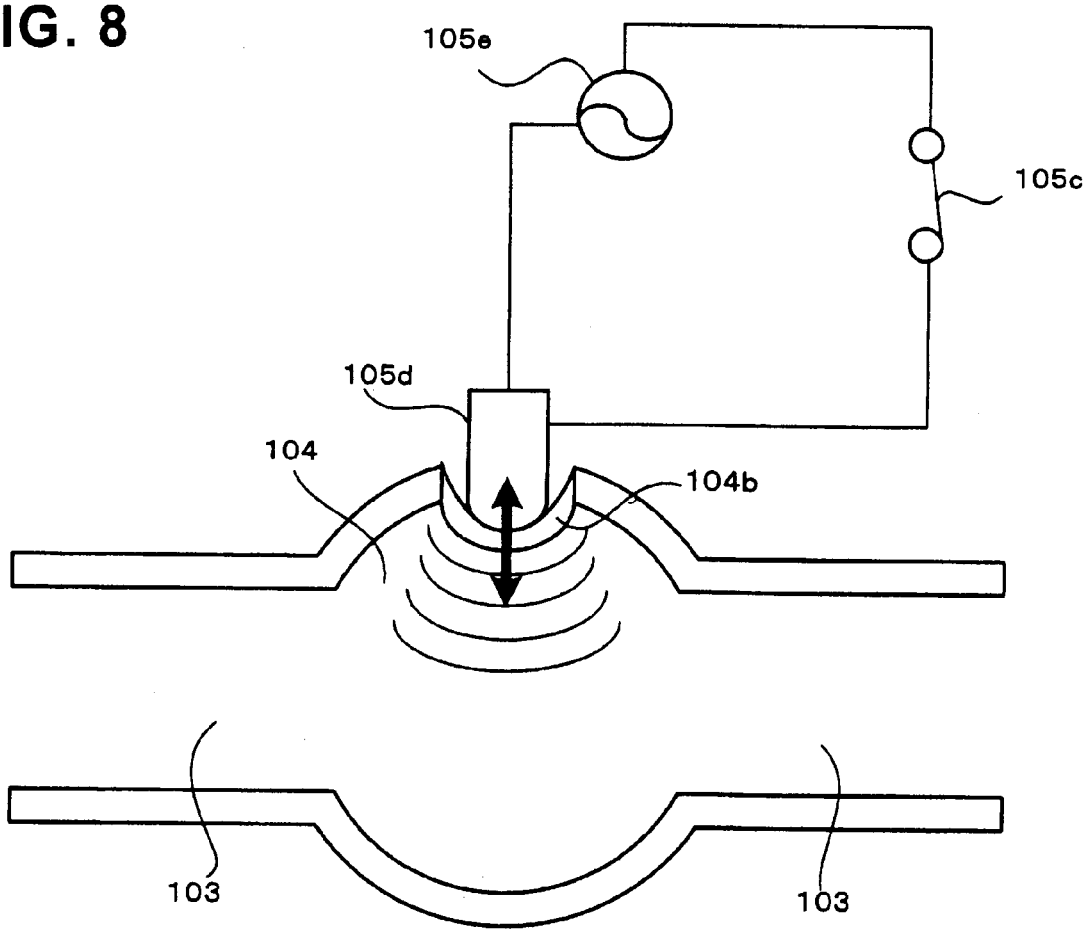
FIG. 8 is a diagram illustrating drive of the mixing component related to the second aspect.

FIG. 7 is a schematic diagram illustrating a second aspect of the mixing component, and FIG. 8 is a diagram illustrating drive in the second aspect.

As illustrated in FIG. 7, the mixing pot 104 has a hollow spherical shape and bulges out from the third channel 103. Part of the outer shell that divides the outside from the inside of the mixing pot 104 is formed by an elastic membrane 104*b*. This elastic membrane 104*b* is composed of an elastic member such as rubber, and is flexed by an external force. The flexure of the elastic membrane 104*b* continuously causes transformation of part of the mixing pot 104, and this transformation becomes a stirring force that stirs the sample solution and the reagent solution inside.

An actuator 105*d* is placed in contact with the elastic membrane 104*b* from the outside of the mixing pot 104. The actuator 105*d* includes an actuator body and a supporting member that slides the actuator body. As illustrated in FIG. 8, the actuator 105*d* reciprocates to repeat protrusion and retraction to and from the elastic membrane 104*b* with electric power. By this reciprocation, the elastic membrane 104*b* is flexed and returned from the flexed state repeatedly, whereby part of the mixing pot 104 continuously transforms. This transforming force is diffused inside the mixing pot 104 to stir the sample solution and the reagent solution. A conductive wire is mounted on the actuator 105*d*, and the conductive wire is connected to a power source 105*e* and the switch 105*c*. The power source 105*e*, the actuator 105*d* and the switch 105*c* compose the mixing acceleration part 105.

Similarly to the first aspect, the monitoring part 106 includes the light source 106*b* and the image sensor 106*a*. The image sensor 106*a* obtains a projection image of the mixing pot 104 as the monitoring-result data. On the basis of analysis of this projection image, the switch 105*c* is switched on/off and the amplitude and cycle of the pulse outputted by the oscillator 105*b* are controlled to regulate the stirring force.

Figure 9:
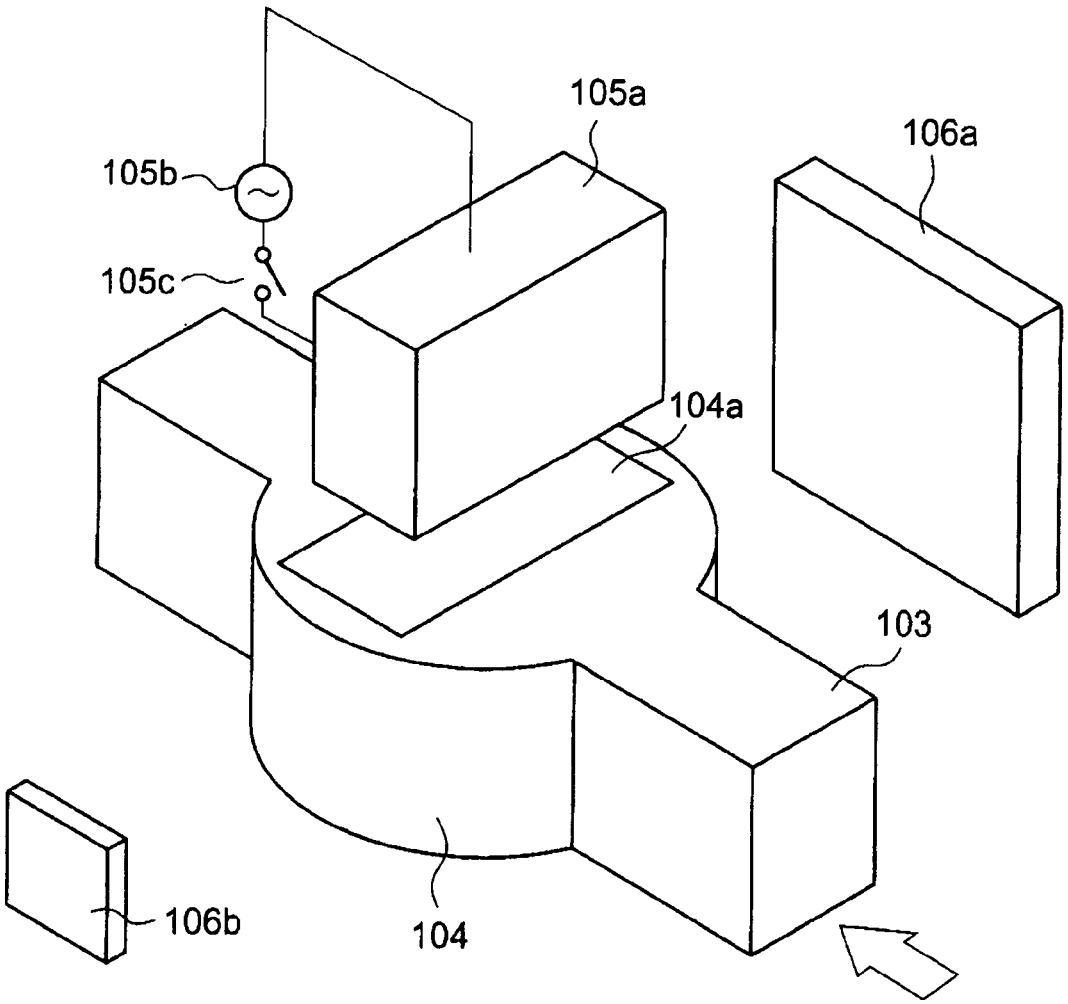
FIG. 9 is a schematic diagram illustrating a third aspect of the mixing component.
Figure 10:
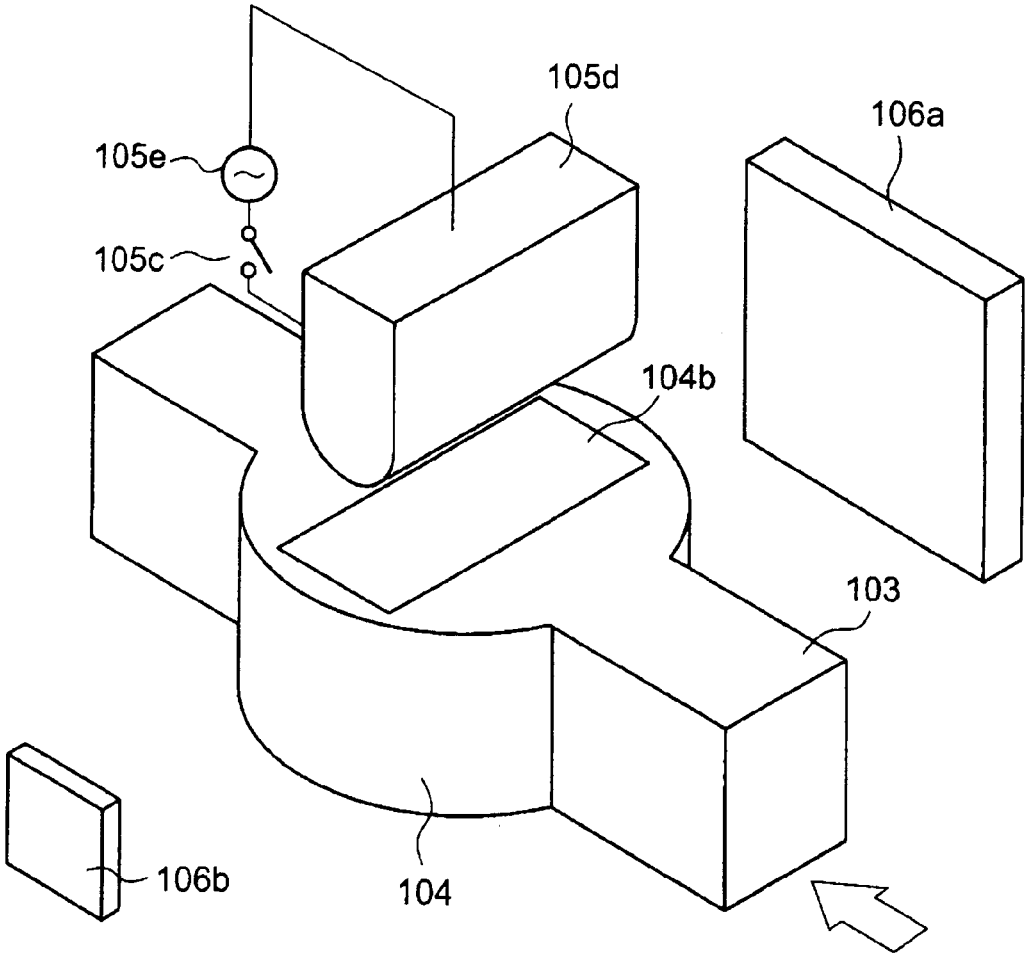
FIG. 10 is a schematic diagram illustrating a fourth aspect of the mixing component.

FIG. 9 is a schematic diagram illustrating a third aspect of the mixing component, and FIG. 10 is a schematic diagram illustrating a fourth aspect of the mixing component. As illustrated in FIGS. 9 and 10, the mixing pot 104 has a hollow cylindrical shape, and bulges out from the third channel 103 so that the radial direction is stretched in the extending direction of the third channel 103. Each of the transmission channel 104*a* and the elastic membrane 104*b* is situated on one surface of the cylinder.

Figure 11:
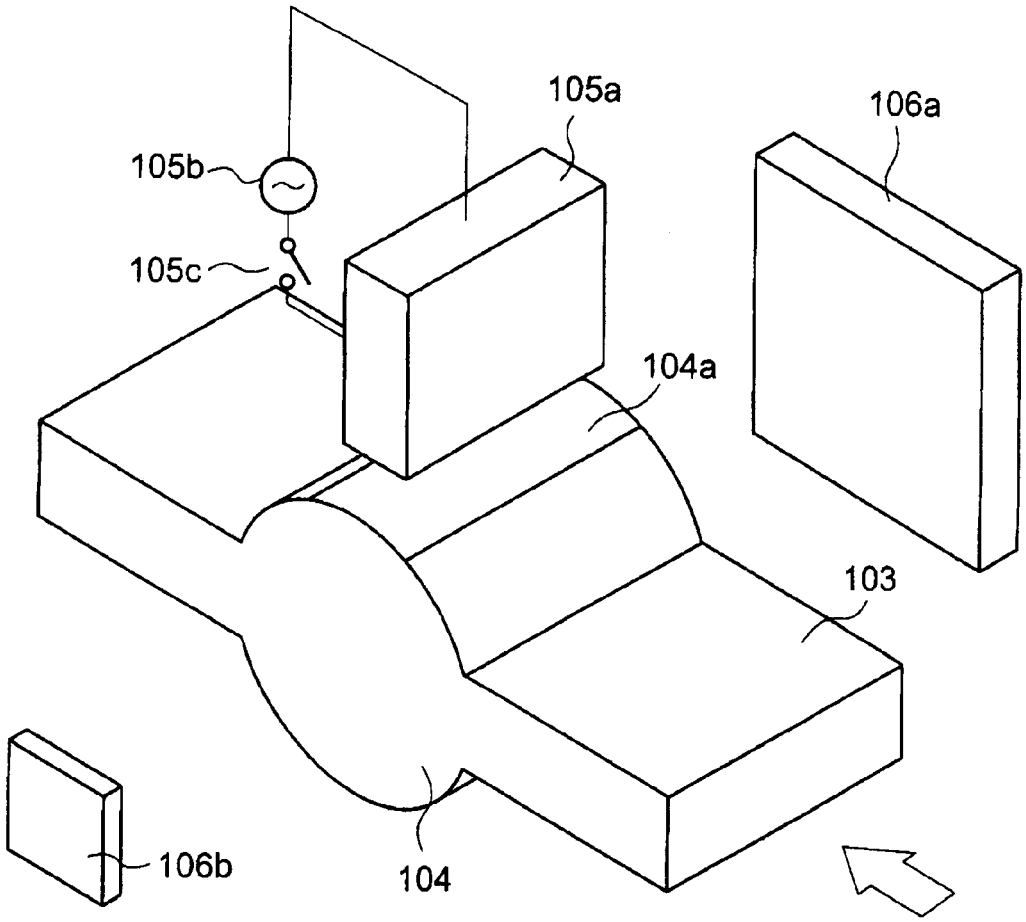
FIG. 11 is a schematic diagram illustrating a fifth aspect of the mixing component.
Figure 12:
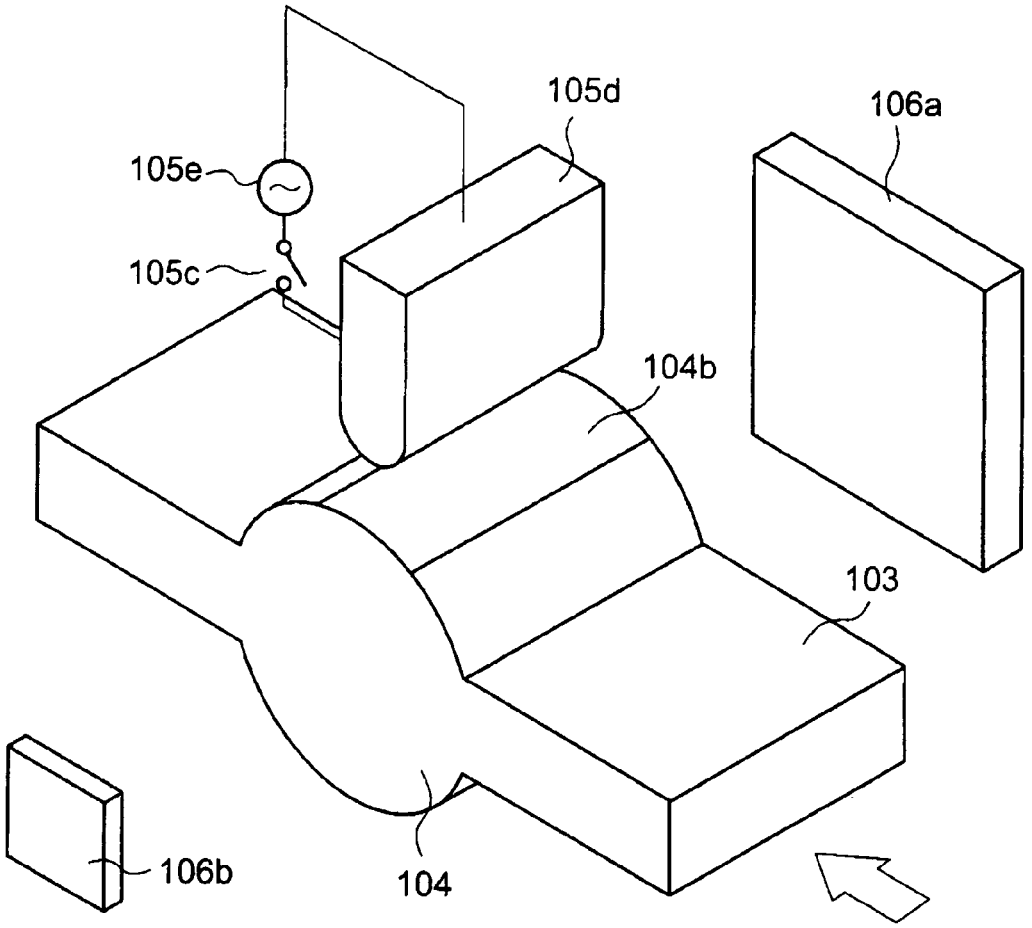
FIG. 12 is a schematic diagram illustrating a sixth aspect of the mixing component.

FIG. 11 is a schematic diagram illustrating a fifth aspect of the mixing component, and FIG. 12 is a schematic diagram illustrating a sixth aspect of the mixing component. As illustrated in FIGS. 11 and 12, the mixing pot 104 has a hollow cylindrical shape, and bulges out from the third channel 103 so that the radial direction is stretched in a direction orthogonal to the extending direction of the third channel 103. Each of the transmission channel 104*a* and the elastic membrane 104*b* is situated on part of the periphery of the cylinder.

Figure 13:
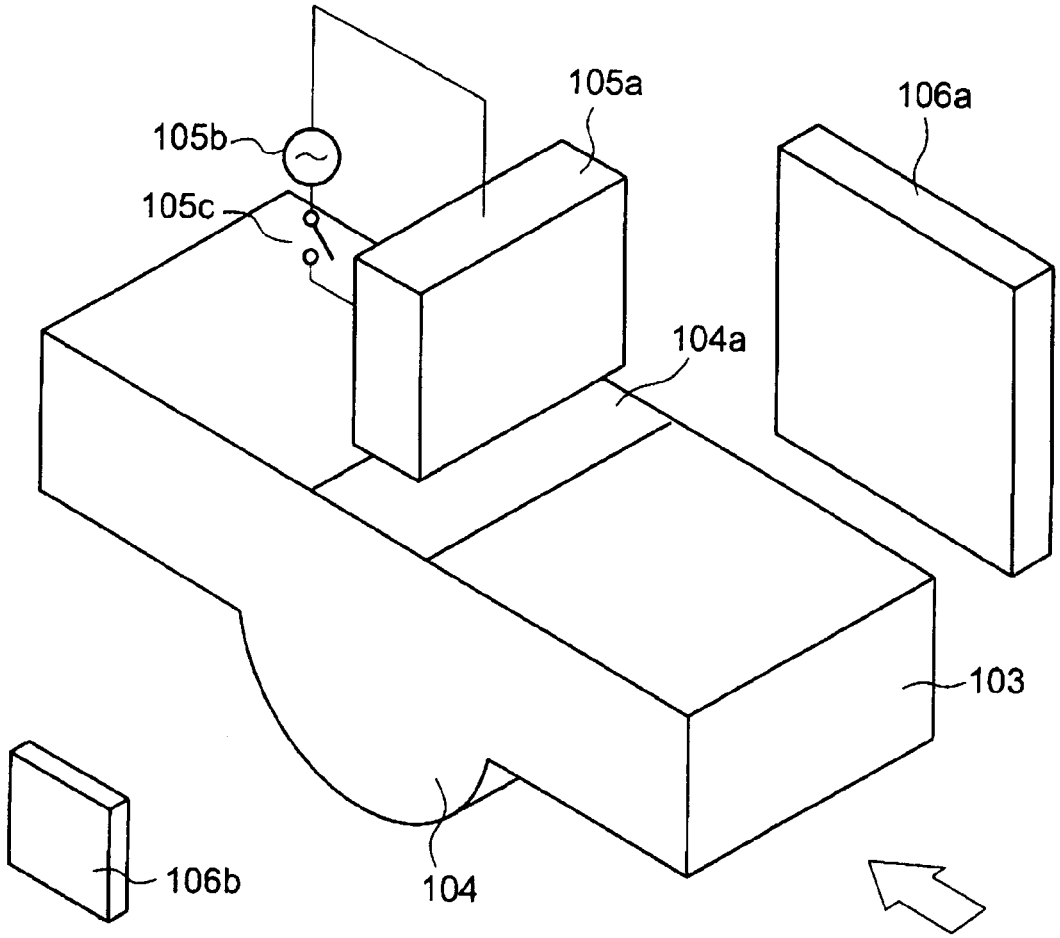
FIG. 13 is a schematic diagram illustrating a seventh aspect of the mixing component.
Figure 14:
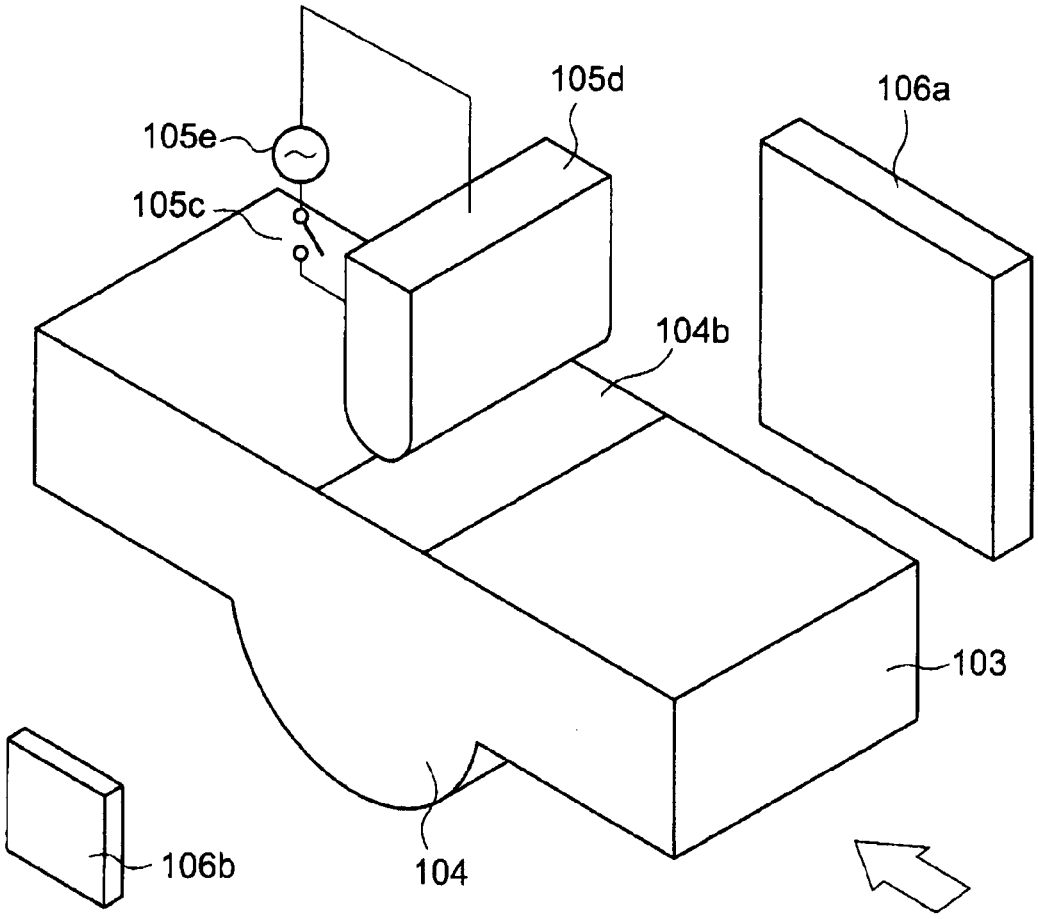
FIG. 14 is a schematic diagram illustrating an eighth aspect of the mixing structure.

FIG. 13 is a schematic diagram illustrating a seventh aspect of the mixing component, and FIG. 14 is a schematic diagram illustrating an eighth aspect of the mixing component. As illustrated in FIGS. 13 and 14, the mixing pot 104 has a hollow fan shape. Part of a circular arc shape of the mixing pot 104 bulges out from one side of the third channel 103. A direction in which the surface of a circular arc face extends coincides with the extending direction of the third channel 103. Each of the transmission channel 104*a* and the elastic membrane 104*b* is situated on part of a face forming a chord.

Figure 15:
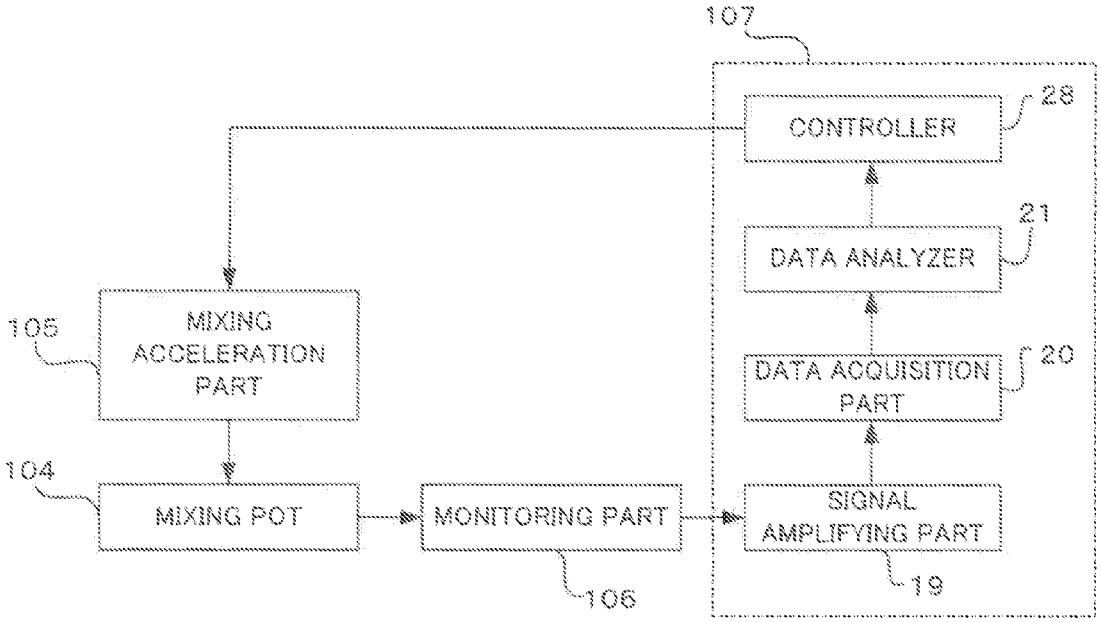
FIG. 15 is a block diagram illustrating a configuration that implements mixing acceleration control of the chemical analysis system.

Next, acceleration control of mixing of the sample solution and the reagent solution in the chemical analysis system 1 will be described. FIG. 15 is a block diagram illustrating a configuration to execute the mixing acceleration control in the chemical analysis system 1. As illustrated in FIG. 15, the mixing controller 107 comprises the signal amplification part 19, the data acquisition part 20, the data analyzer 21, and the controller 28. This mixing controller 107 analyzes data on the result of monitoring by the monitoring part 106 to ascertain the degree of mixture of the sample solution and the reagent solution, and controls the mixing acceleration part 105 in accordance with the degree of the mixture. The monitoring-result data is inputted into the mixing controller 107 via the interface part 17. In other words, the monitoring-result data is stored in the data acquisition part 20 after being amplified by the signal amplification part 19. The data analyzer 21 analyzes the monitoring-result data stored in the data acquisition part 20.

Figure 16:
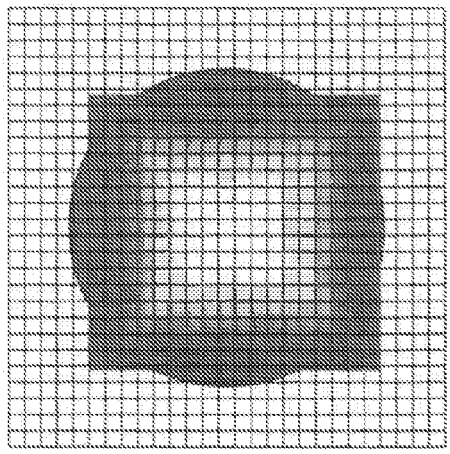
FIG. 16 is a schematic diagram illustrating a projection image of the mixing pot, which is monitoring-result data, and illustrates a condition in which a sample solution and a reagent solution have not been uniformly mixed yet.
Figure 17:
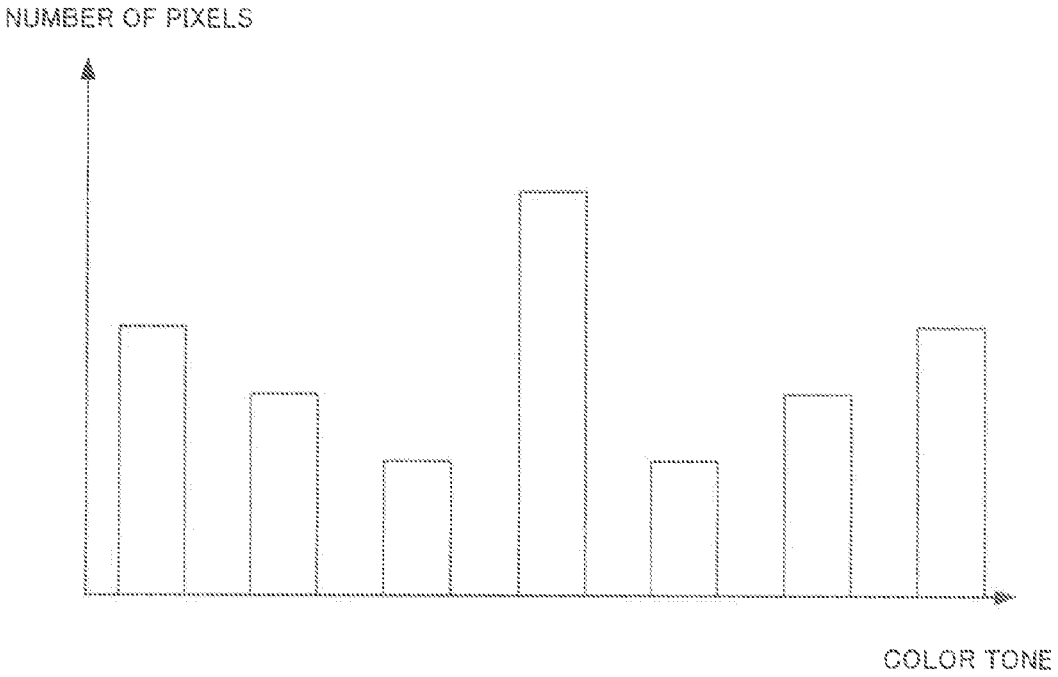
FIG. 17 is a diagram illustrating a histogram generated when mixture of a sample solution with a reagent solution is incomplete.

FIG. 16 is a schematic diagram illustrating the projection image of the mixing pot 104, which is the monitoring-result data. FIG. 16 illustrates a condition in which the solutions have not been uniformly mixed yet. As illustrated in FIG. 16, the projection image contains color of the sample solution, color of the reagent solution, and color of the mixed solution of the sample solution and the reagent solution, so that large inhomogeneity of color tone is caused. The data analyzer 21 generates a histogram indicative of the inhomogeneity of color tone of the projection image. The inhomogeneity of color tone is digitized from the histogram and compared with the presorted threshold. The controller 28 controls the mixing acceleration part 105 in accordance with the result of the comparison. The inhomogeneity of color tone is obtained by digitizing the distribution width of the histogram or the peak of the histogram. The histogram indicates the degree of mixture of the sample solution and the reagent solution. The histogram of color tone is data such that the pixel values of the projection image are screened in a plurality of color tones to divide into a plurality of sections, the sections are taken on the horizontal axis, and the number of pixels having a color tone contained in that section are taken on the vertical axis. The variation of color tones distributed within the projection image and the distribution width are expressed. FIG. 17 is a diagram illustrating a histogram generated when mixture of the sample solution and the reagent solution is incomplete. In the histogram generated when mixture of the sample solution and the reagent solution is incomplete, a distribution width of color tones is wide, and a peak value of the distribution is low. This is because various color tones exist due to incomplete mixture, and the quantity of mixed portion is small as compared with the total quantity of the sample solution and reagent solution.

Figure 18:
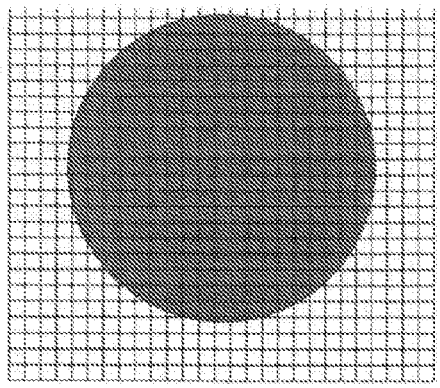
FIG. 18 is a schematic diagram illustrating a projection image of the mixing pot, which is monitoring-result data, and illustrates a condition in which a sample solution and a reagent solution have been uniformly mixed.
Figure 19:
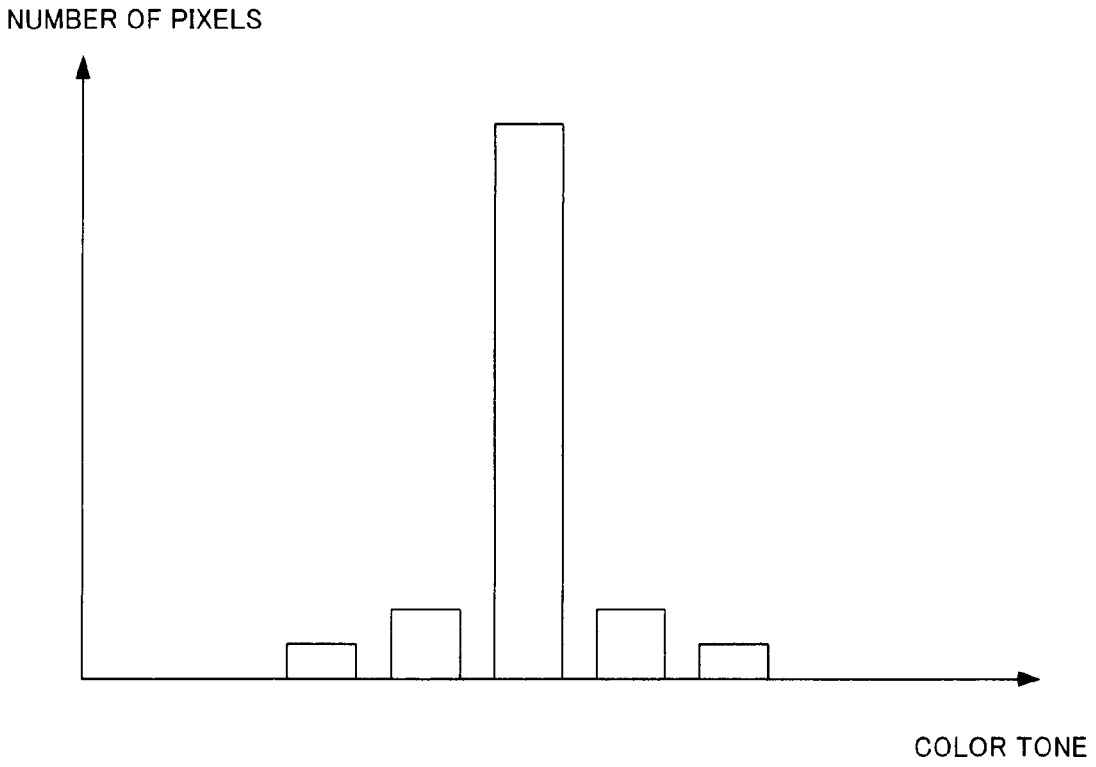
FIG. 19 is a diagram illustrating a histogram generated from the projection image of a state in which a sample solution and a reagent solution have been mixed uniformly.

On the other hand, FIG. 18 is a schematic diagram illustrating a projection image of the mixing pot 104 that constitutes the monitoring-result data. FIG. 18 represents a condition in which the sample solution and reagent solution are mixed uniformly. As illustrated in FIG. 18, since the sample solution and reagent solution are uniformly mixed in the projection image, it is unified as a single color tone and has little inhomogeneity of color tone. FIG. 19 is a diagram illustrating a histogram generated from the projection image in a condition in which the sample solution and the reagent solution are mixed uniformly. Because the sample solution and reagent solution are mixed uniformly, the distribution width of the histogram is narrow, and the peak value is high.

Figure 20:
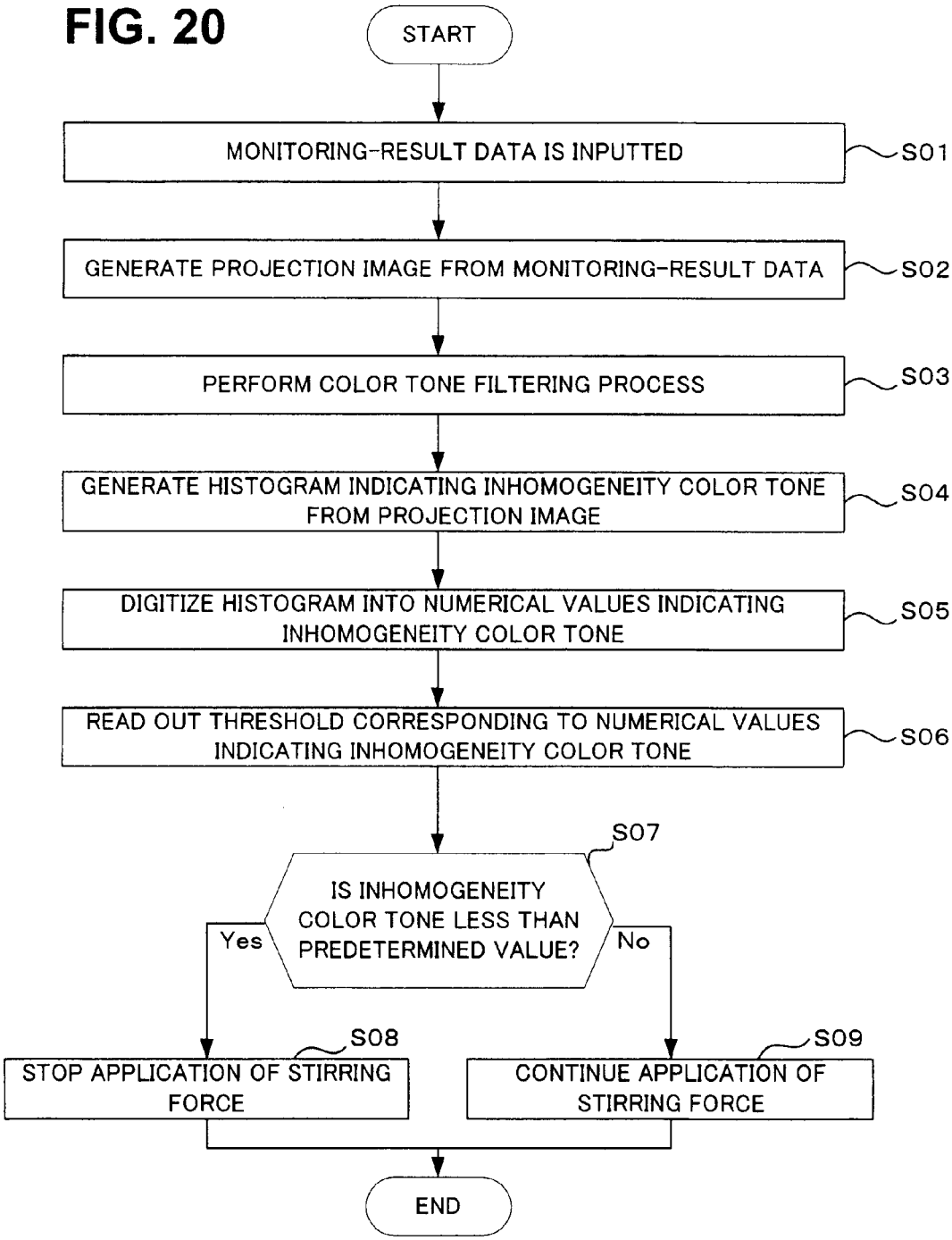
FIG. 20 is a flowchart illustrating a first mixing acceleration control operation of the mixing controller.
Figure 21:
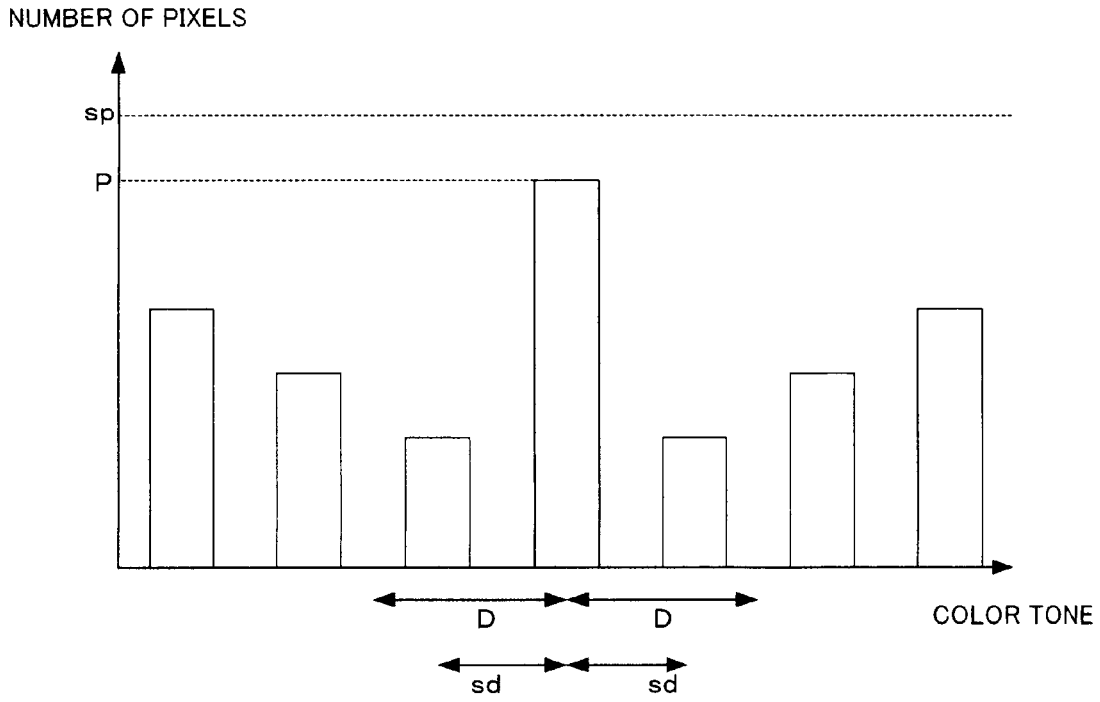
FIG. 21 is a diagram illustrating the relationship between the histogram generated in the first mixing acceleration control operation and the threshold.

FIG. 20 is a flowchart illustrating a first mixing acceleration control operation by the mixing controller 107. FIG. 21 is a diagram illustrating the relationship between a histogram generated in the first mixing acceleration control operation and a threshold. In the first mixing acceleration control aspect, the mixing controller 107 switches on/off the switch 105*c* of the mixing acceleration part 105. When the inhomogeneity of color tone inside the mixing pot 104 is less than a predetermined value, the switch 105*c* of the mixing acceleration part 105 is switched off to stop applying a stirring force. When the inhomogeneity of color tone inside the mixing pot 104 is equal to or more than the predetermined value, the switch 105*c* of the mixing acceleration part 105 is kept on to continue applying a stirring force.

First, when the monitoring-result data is inputted by the monitoring part 106 (S01), the mixing controller 107 generates a projection image by converting the signal strength into pixel values (S02), and performs a color tone filtering process on the projection image (S03). Next, the mixing controller 107 generates a histogram indicating the inhomogeneity of color tone from the obtained projection image (S04), and digitizes the histogram into numerical values indicative of the inhomogeneity of color tone (S05). The numerical values indicative of the inhomogeneity of color tone obtained by digitizing the histogram are a peak value P and a statistical distribution value D of the histogram. As for the peak value P, the larger the value is, the less the inhomogeneity of color tone is. As for the distribution value D, the smaller the value is, the less the inhomogeneity of color tone is.

Upon obtaining the numerical values indicative of the inhomogeneity of color tone, the mixing controller 107 reads out a threshold corresponding to the numerical value indicative of the inhomogeneity of color tone, or in other words, reads out a threshold sp that corresponds to the peak value P or a threshold sd that corresponds to the distribution value D (S06), and compares the derived numerical value indicative of inhomogeneity of color tone with the threshold (S07). When the result of the comparison indicates that the inhomogeneity of color tone is less than the predetermined value (S07, Yes), the mixing controller 107 causes the mixing acceleration part 105 to stop applying the stirring force (S08). On the other hand, when the inhomogeneity of color tone is equal to or more than the predetermined value (S07, No), the mixing controller 107 causes the mixing acceleration part 105 to continue applying the stirring force (S09).

A state in which the inhomogeneity of color tone is less than a predetermined value is a state in which assuming the numerical value indicative of the inhomogeneity of color tone is the peak value P, this peak value P is above the threshold sp. A state in which the inhomogeneity of color tone is equal to or more than a predetermined value is a state in which assuming the numerical value indicative of the inhomogeneity of color tone is the peak value P, the peak value P is equal to or less than the threshold sp. Further, a state in which the inhomogeneity of color tone is less than a predetermined value is a state in which assuming the numerical value indicative of the inhomogeneity of color tone is the distribution value D, the distribution value D is below the threshold sd. A state in which the inhomogeneity of color tone is equal to or more than a predetermined value is a state in which assuming the numerical value indicative of the inhomogeneity of color tone is the distribution value D, the distribution value D is above the threshold sd.

Figure 22:
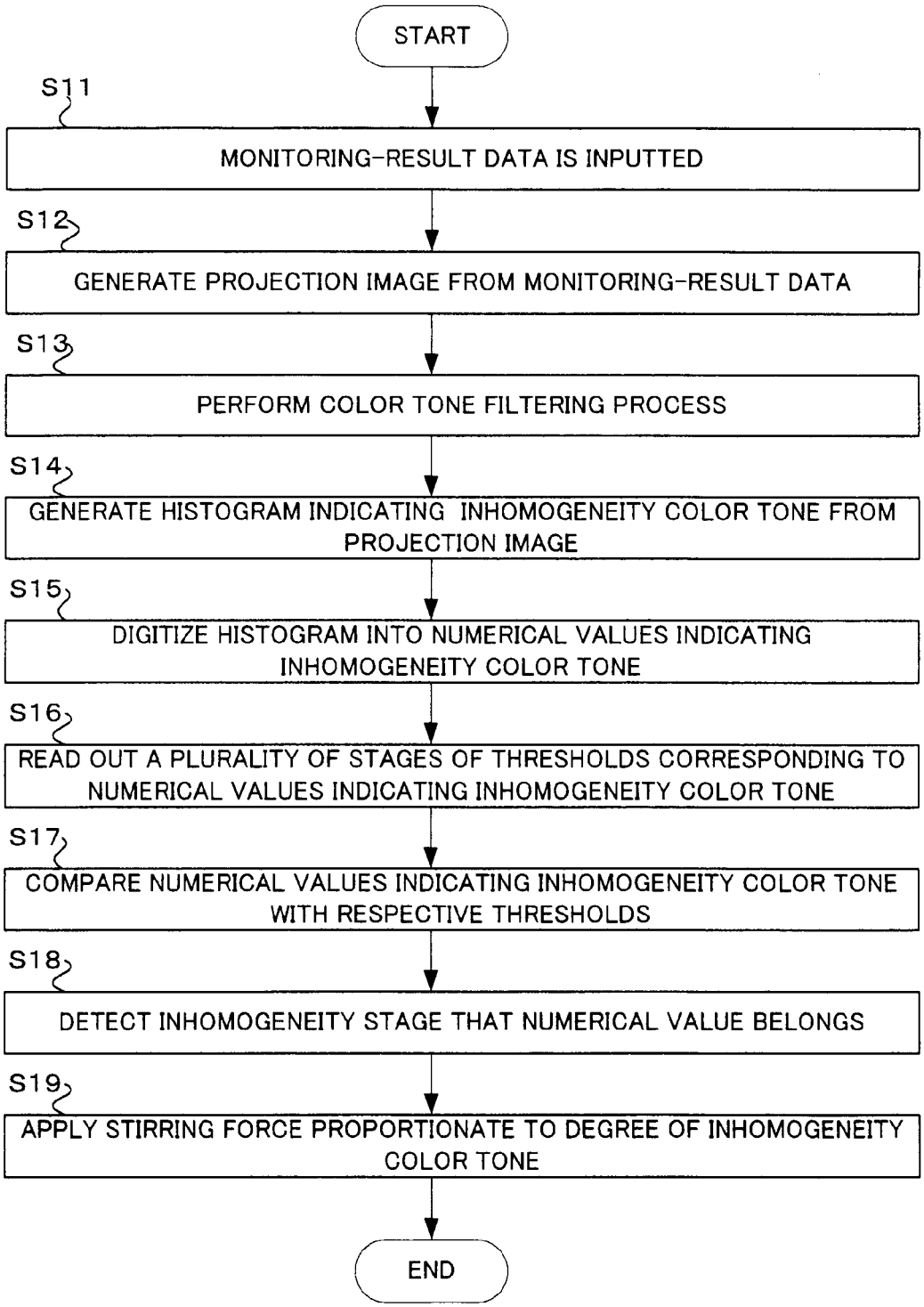
FIG. 22 is a flowchart illustrating a second mixing acceleration control operation of the mixing controller.
Figure 23:
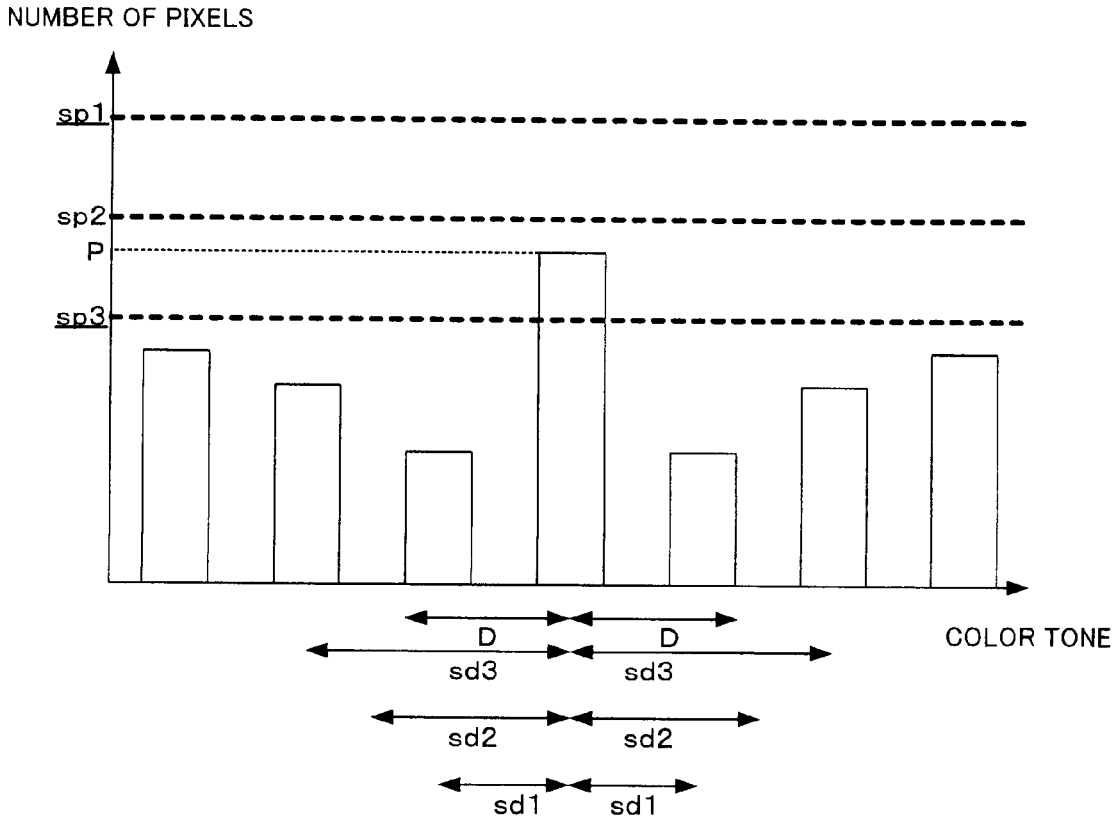
FIG. 23 is a diagram illustrating the relation between the histogram generated in the second mixing acceleration control operation and the threshold.

FIG. 22 is a flowchart illustrating a second mixing acceleration control operation of the mixing controller 107. Moreover, FIG. 23 is a diagram illustrating the relationship between a histogram generated in the second mixing acceleration control operation and the threshold. As for the second mixing acceleration control aspect, the mixing controller 107 applies a stirring force proportionate to the degree of the inhomogeneity of color tone inside the mixing pot 104, by increasing and decreasing the interval of pulses outputted by the oscillator 105*b* of the mixing acceleration part 105 and the electric power of the power source 105*e* to control the driving force of the mixing acceleration part 105.

First, when the monitoring-result data is inputted by the monitoring part 106 (S11), the mixing controller 107 converts the signal strength into pixel values to generate a projection image (S12), and performs a color tone filtering process on the projection image (S13). Next, the mixing controller 107 generates a histogram indicative of the inhomogeneity of color tone from the obtained projection image (S14), and converts the histogram into numerical values indicative of the inhomogeneity of color tone (S15). The numerical values indicative of the inhomogeneity of color tone obtained by digitizing the histogram are the peak value P and the histogram's statistical distribution value D. As for the peak value P, the larger the value is, the smaller the inhomogeneity of color tone is. As for the distribution value D, the smaller the value is, the smaller the inhomogeneity of color tone is.

Upon obtaining a numerical value indicative of the inhomogeneity of color tone, the mixing controller 107 reads out multiple stages of thresholds sp1, sp2, sp3, . . . that correspond to the peak value P or multiple stages of thresholds sd1, sd2, sd3, . . . that correspond to the distribution value D (S16), and compares the obtained numerical value indicative of the inhomogeneity of color tone with each of the thresholds (S17) to detect a stage of inhomogeneity to which the numerical value belongs (S18).

The numerical value of the threshold becomes larger in the order of sp3<sp2<sp1. Assuming the numerical value indicative of the inhomogeneity of color tone is the peak value P, when the value is above the threshold sp1, the inhomogeneity of color tone belongs to the first stage, and when the threshold sp2 is the maximum threshold that the value exceeds, the inhomogeneity of color tone belongs to the second stage. Further, the numerical value of the threshold becomes larger in the order of sd1<sd2<sd3. Assuming the numerical value indicative of the inhomogeneity of color tone is the distribution value D, when the value is below the threshold sd1, the inhomogeneity of color tone belongs to the first stage, and when the threshold sd2 is the minimum that the value is below, the inhomogeneity of color tone belongs to the second stage. In other words, the lower the stage is, the smaller the inhomogeneity of color tone is, whereas the higher the stage is, the larger the inhomogeneity of color tone is.

Upon detecting the stage to which the inhomogeneity of color tone belongs, the mixing controller 107 causes the mixing acceleration part 105 to apply a stirring force proportionate to the degree of the inhomogeneity of color tone, or in other words, proportionate to the stage to which the inhomogeneity of color tone belongs (S19). When a stage to which the inhomogeneity of color tone belongs reaches the first stage, the mixing controller 107 stops the stir.

As described above, in the present embodiment, the system comprises the mixing pot 104 that is interposed in the junction of the sample solution and the reagent solution or in the channel after the junction, and that temporarily retains the sample solution and the reagent solution. Consequently, most of the sample solution and reagent solution is temporarily retained, and mixed by the turbulent flow or vortex flow while being retained. Because the sample solution and the reagent solution are uniformly mixed and then delivered by flowing out of the mixing pot 104 downstream of the third channel 103, the need for mixing inside the third channel 103 is reduced at least. Accordingly, the solutions are mixed uniformly at once by the turbulent flow or vortex flow generated within the mixing pot before being delivered to the third channel, whereby the mixing time can be shortened as compared with when mixing inside the third channel 103. Thus, it is possible to shorten the third channel 103, and reduce the size of the mixing device 3. Further, because the reaction starts under a condition that most of the sample solution and reagent solution is retained in one location, there is no non-uniformity in reaction, so that the occurrence of errors in the result of the reaction can be prevented.

Moreover, the system comprises the mixing acceleration part 105 configured to apply a stirring force to the inside of the mixing pot 104. Because the mixing acceleration part 105 is situated so as to apply a stirring force to the inside of the mixing pot 104 in which most of the sample solution and reagent solution is temporarily retained, compared to when partially applying a stirring force to a mixed solution transiting an area in which a mixing acceleration part is installed inside the channel, the stirring effect is increased dramatically, the mixing time is reduced, and it is possible to mix more securely and uniformly.

Furthermore, the system comprises the monitoring part 106 to monitor the degree of mixture of the sample solution and the reagent solution inside the mixing pot 104, and the system is configured so as to control stoppage and continuation of application of the stirring force as well as increase and decrease of the stirring force by the mixing acceleration part 105 based on the result of monitoring by the monitoring part 106. Consequently, a sufficient amount of stirring force can be applied until most of the sample solution and reagent solution is uniformly mixed, whereby uniform mixture is assured. Moreover, the need to alternately install mixing acceleration parts 105 and monitoring parts 106 in multiple stages along the third channel 103 is eliminated, so that the cost can be reduced, and the size of the mixing device 3 can be reduced.

In addition, the monitoring part 106 may be installed on either the side of the analysis device 2 or the side of the mixing device 3. In a case where the monitoring part 106 is disposed to the side of the analysis device 2, the monitoring-result data is inputted into the controller 28 without passing through the interface part 17. Furthermore, the mixing controller 107, mixing acceleration part 105, and monitoring part 106 may be situated on the side of the mixing device 3. The analysis sensor 16 may be situated on the side of the analysis device 2.

What is claimed is:

1. A microchemical analysis system configured to mix heterogeneous solutions and make them react to thereby perform chemical analysis of one of the solutions, the microchemical analysis system comprising:

a channel configured to merge and deliver a first solution and a second solution;

a mixing pot that is interposed in a junction of the first solution and the second solution or in the channel after the junction, that bulges out from the channel to have a predetermined capacity, and that is configured to temporarily retain the first solution and the second solution to flow out a mixed solution which is formed by a mixture of the first solution and the second solution;

a mixing acceleration part configured to apply a stirring force to the first and the second solutions temporarily retained inside the mixing pot;

a monitoring part configured to monitor a degree of mixture of the first solution and the second solution within the mixing pot during an application of the stirring force;

a mixing controller programmed to cause the mixing acceleration part to apply a stirring force, which is increased as a level of inhomogeneity of color tone is higher during the application of the stirring force;

an analysis sensor configured to detect a result of reaction of the first solution and the second solution that flow out of the mixing pot; and a processing part configured to convert a result of reaction outputted by the analysis sensor into a physical quantity indicative of a chemical property of the solution.

2. A microchemical analysis system according to claim 1, wherein the mixing pot has a spherical shape.

3. A microchemical analysis system according to claim 1, wherein the mixing pot has a cylindrical shape having a radial direction along an extension direction of the channel.

4. A microchemical analysis system according to claim 1, wherein the mixing pot has a cylindrical shape having a radial direction orthogonal to an extension direction of the channel.

5. A microchemical analysis system according to claim 1, wherein the mixing pot has a fan shape in which part of a circular arc shape bulges out from one face of the channel.

6. A microchemical analysis system according to claim 1, wherein the mixing acceleration part includes a piezoelectric device that generates vibrational waves.

7. A microchemical analysis system according to claim 1, wherein the mixing acceleration part includes an actuator coming in contact with the mixing pot to transform part of the mixing pot.

8. A microchemical analysis system according to claim 1, wherein the mixing controller causes the mixing acceleration part to continue or stop application of a stirring force, in accordance with a result of monitoring by the monitoring part.

9. A microchemical analysis system according to claim 1, wherein the monitoring part includes an image sensor obtaining a projection image of the inside of the mixing pot, and outputs the projection image of the mixing pot as a result of monitoring.

10. A microchemical analysis system according to claim 1, wherein:

the monitoring part includes an image sensor obtaining a projection image of the inside of the mixing pot, and outputs the projection image of the mixing pot as a result of monitoring; and the mixing controller, based on the projection image, stops application of a stirring force when inhomogeneity of color tone within the mixing pot is less than a predetermined degree, and continues application of a stirring force when inhomogeneity of color tone within the mixing pot is equal to or more than a predetermined degree.

11. A microchemical analysis system according to claim 1, wherein:

the monitoring part includes an image sensor obtaining a projection image of the inside of the mixing pot, and outputs the projection image of the mixing pot as a result of monitoring; and the mixing controller, based on the projection image, applies a stirring force proportional to a degree of inhomogeneity of color tone within the mixing pot.

12. A microchemical analysis system according to claim 1, wherein the mixing pot includes an outer shell that divides an outside of the mixing pot from an inside of the mixing pot, wherein a portion of the outer shell of the mixing pot is formed of an elastic membrane, and wherein the mixing acceleration part contacts the elastic membrane to apply the stirring force to the first and second solutions.

13. A microchemical analysis system according to claim 12, wherein the elastic membrane is configured to be flexed by the mixing acceleration part so as to extend to the inside of the mixing pot to apply the stirring force to the first and second solutions.

14. A micro mixing device configured to mix heterogeneous solutions, the micro mixing device comprising:

a channel configured to merge and deliver a first solution and a second solution;

a mixing pot that is interposed in a junction of the first solution and the second solution or in the channel after the junction, that bulges out from the channel to have a predetermined capacity, and that is configured to temporarily retain the first solution and the second solution to flow out a mixed solution which is formed by a mixture of the first solution and the second solution;

a mixing acceleration part configured to apply a stirring force to the first and the second solutions temporarily retained inside the mixing pot;

a monitoring part configured to monitor a degree of mixture of the first solution and the second solution within the mixing pot during an application of the stirring force; and a mixing controller programmed to cause the mixing acceleration part to apply a stirring force, which is increased as a level of inhomogeneity of color tone is higher during the application of the stirring force based on a result of monitoring by the monitoring part.

15. A microchemical analysis device, wherein the microchemical device is connected to a micro mixing device comprising a channel configured to merge and deliver a first solution and a second solution and a mixing pot that is interposed in a junction of the first solution and the second solution or in the channel after the junction, that bulges out from the channel to have a predetermined capacity, and that is configured to temporarily retain the first solution and the second solution to flow out a mixed solution which is formed by a mixture of the first solution and the second solution, and which analyzes a chemical property of one of the solutions from a result of reaction of these solutions that flow out of the mixing pot, the microchemical analysis device comprising:

a mixing acceleration part configured to apply a stirring force to the first and the second solutions temporarily retained inside the mixing pot;

a monitoring part configured to monitor a degree of mixture of the first solution and the second solution within the mixing pot during an application of the stirring force;

a mixing controller programmed to cause the mixing acceleration part to apply a stirring force, which is increased as a level of inhomogeneity of color tone is higher during the application of the stirring force based on a result of monitoring by the monitoring part; and a processing part configured to convert the reaction result into a physical quantity indicative of chemical properties of the solution.

* * * * *